US009803456B2

(12) United States Patent
Kerr

(10) Patent No.: US 9,803,456 B2
(45) Date of Patent: Oct. 31, 2017

(54) SAGDOX GEOMETRY FOR IMPAIRED BITUMEN RESERVOIRS

(71) Applicant: Nexen Energy ULC, Calgary, Alberta (CA)

(72) Inventor: Richard Kelso Kerr, Calgary (CA)

(73) Assignee: NEXEN ENERGY ULC, Alberta (CA)

( * ) Notice: Subject to any disclaimer, the term of this patent is extended or adjusted under 35 U.S.C. 154(b) by 395 days.

(21) Appl. No.: 13/893,902

(22) Filed: May 14, 2013

(65) Prior Publication Data

US 2013/0248177 A1 Sep. 26, 2013

Related U.S. Application Data

(63) Continuation-in-part of application No. 13/543,012, filed on Jul. 6, 2012, and a continuation-in-part of application No. 13/628,164, filed on Sep. 27, 2012.

(60) Provisional application No. 61/647,153, filed on May 15, 2012, provisional application No. 61/507,196, filed on Jul. 13, 2011, provisional application No. 61/549,770, filed on Oct. 21, 2011.

(51) Int. Cl.

| | |
|---|---|
| ***E21B 43/24*** | (2006.01) |
| ***E21B 43/30*** | (2006.01) |
| ***C10G 1/00*** | (2006.01) |
| ***C10G 1/04*** | (2006.01) |
| ***C10G 9/38*** | (2006.01) |

(52) U.S. Cl.

CPC ..... *E21B 43/2406* (2013.01); *C10G 1/002* (2013.01); *C10G 1/047* (2013.01); *C10G 9/38* (2013.01); *E21B 43/2408* (2013.01); *E21B 43/30* (2013.01); *C10G 2300/1033* (2013.01); *C10G 2300/4037* (2013.01)

(58) Field of Classification Search

CPC ..... C09K 8/594; C09K 8/592; E21B 43/0122; E21B 43/168; E21B 43/2408

USPC ..... 166/272.3

See application file for complete search history.

(56) References Cited

U.S. PATENT DOCUMENTS

| | | | |
|---|---|---|---|
| 3,905,422 | A | 9/1975 | Woodward |
| 3,938,590 | A | 2/1976 | Redford et al. |
| 3,976,137 | A | 8/1976 | Bousaid |

(Continued)

FOREIGN PATENT DOCUMENTS

| | | |
|---|---|---|
| CA | 1027856 | 1/1976 |
| CA | 1032078 | 1/1976 |

(Continued)

OTHER PUBLICATIONS

Adams et al., "Controls on the Variability of Fluid Properties of Heavy Oils and Bitumen in Foreland Basin: A Case History From the Albertan Oil Sands", Search & Discovery Article #40275, Mar. 10, 2008.

(Continued)

*Primary Examiner* — Zakiya W Bates
*Assistant Examiner* — Ashish Varma
(74) *Attorney, Agent, or Firm* — Norton Rose Fulbright Canada LLP; Paul J. Field

(57) ABSTRACT

A process to utilize at least one water lean zone (WLZ) interspersed within a net pay zone in a reservoir and produce bitumen from the reservoir, includes using Steam Assisted Gravity Drainage with Oxygen (SAGDOX) to enhance oil recovery, locating a SAGDOX oxygen injector proximate the WLZ, and removing non-condensable gases.

26 Claims, 20 Drawing Sheets

SAGD WELL CONFIGURATION

(56) References Cited

U.S. PATENT DOCUMENTS

| | | | |
|---|---|---|---|
| 3,978,925 | A | 9/1976 | Redford |
| 3,991,828 | A | 11/1976 | Allen et al. |
| 3,993,132 | A | 11/1976 | Cram et al. |
| 4,006,778 | A | 2/1977 | Redford et al. |
| 4,024,915 | A | 5/1977 | Allen |
| 4,026,357 | A | 5/1977 | Redford |
| 4,048,078 | A | 9/1977 | Allen |
| 4,083,404 | A | 4/1978 | Allen |
| 4,114,690 | A | 9/1978 | Cram et al. |
| 4,124,071 | A | 11/1978 | Allen et al. |
| 4,127,172 | A | 11/1978 | Redford et al. |
| 4,133,382 | A | 1/1979 | Cram et al. |
| 4,217,956 | A | 8/1980 | Goss et al. |
| 4,252,191 | A | 2/1981 | Pusch et al. |
| 4,265,310 | A | 5/1981 | Britton et al. |
| 4,427,066 | A | 1/1984 | Cook |
| 4,512,403 | A | 4/1985 | Santangelo et al. |
| 4,565,249 | A | 1/1986 | Pebdani et al. |
| 4,573,530 | A | 3/1986 | Audeh et al. |
| 4,612,989 | A | 9/1986 | Rakach et al. |
| 4,649,997 | A | 3/1987 | Bousaid |
| 4,682,652 | A | 7/1987 | Huang et al. |
| 4,722,395 | A | 2/1988 | Venkatesan |
| 4,860,827 | A | 8/1989 | Lee et al. |
| 4,993,490 | A | 2/1991 | Stephens et al. |
| 5,217,076 | A | 6/1993 | Masek |
| 5,407,009 | A | 4/1995 | Butler et al. |
| 5,456,315 | A | 10/1995 | Kisman et al. |
| 5,626,193 | A | 5/1997 | Nzekwu et al. |
| 6,015,015 | A | 1/2000 | Luft et al. |
| 6,412,557 | B1 | 7/2002 | Ayasse et al. |
| 7,581,587 | B2 | 9/2009 | Pfefferle |
| 7,740,062 | B2 | 6/2010 | Lim et al. |
| 7,770,646 | B2 | 8/2010 | Klassen et al. |
| 7,780,152 | B2 | 8/2010 | Rao |
| 7,882,893 | B2 | 2/2011 | Fraim |
| 7,900,701 | B2 | 3/2011 | Weiers et al. |
| 8,118,095 | B2 | 2/2012 | Sarathi et al. |
| 8,176,982 | B2 | 5/2012 | Gil et al. |
| 8,210,259 | B2 | 7/2012 | De Francesco |
| 2005/0045332 | A1 | 3/2005 | Howard et al. |
| 2005/0211434 | A1 | 9/2005 | Gates et al. |
| 2006/0042794 | A1 | 3/2006 | Pfefferle |
| 2006/0207762 | A1 | 9/2006 | Ayasse |
| 2006/0213658 | A1 | 9/2006 | Maguire |
| 2006/0231252 | A1 | 10/2006 | Shaw et al. |
| 2007/0187093 | A1 | 8/2007 | Pfefferle |
| 2007/0187094 | A1 | 8/2007 | Pfefferle |
| 2008/0116694 | A1 | 5/2008 | Hendershot |
| 2008/0190813 | A1 | 8/2008 | Dana et al. |
| 2008/0264635 | A1 | 10/2008 | Chhina et al. |
| 2009/0077515 | A1 | 3/2009 | Sinha et al. |
| 2009/0188667 | A1* | 7/2009 | Lim ..... E21B 43/243 166/256 |
| 2009/0194278 | A1 | 8/2009 | De Francesco |
| 2009/0200024 | A1 | 8/2009 | Ayasse et al. |
| 2009/0236092 | A1 | 9/2009 | O'Brien |
| 2009/0272532 | A1 | 11/2009 | Kuhlman |
| 2009/0288827 | A1 | 11/2009 | Coskuner |
| 2010/0065268 | A1* | 3/2010 | Gates ..... E21B 43/305 166/268 |
| 2010/0096126 | A1 | 4/2010 | Sullivan et al. |
| 2010/0212894 | A1 | 8/2010 | Latimer et al. |
| 2010/0276148 | A1 | 11/2010 | Wylie et al. |
| 2012/0247773 | A1 | 10/2012 | Schneider et al. |
| 2013/0098603 | A1 | 4/2013 | Kerr |
| 2013/0146283 | A1 | 6/2013 | Ayasse |
| 2013/0146284 | A1 | 6/2013 | Ayasse |
| 2013/0175031 | A1 | 7/2013 | Kerr |
| 2013/0248177 | A1 | 9/2013 | Kerr |
| 2013/0284435 | A1 | 10/2013 | Kerr |
| 2013/0284461 | A1 | 10/2013 | Kerr |
| 2014/0076555 | A1 | 3/2014 | Kerr |
| 2014/0096960 | A1 | 4/2014 | Kerr |
| 2014/0096962 | A1 | 4/2014 | Kerr |
| 2014/0166278 | A1 | 6/2014 | Kerr |
| 2014/0166279 | A1 | 6/2014 | Kerr |
| 2014/0190689 | A1 | 7/2014 | Warren et al. |

FOREIGN PATENT DOCUMENTS

| | | | |
|---|---|---|---|
| CA | 1054928 | | 5/1977 |
| CA | 1056720 | | 6/1979 |
| CA | 1122113 | | 4/1980 |
| CA | 2532811 | A1 | 7/2003 |
| CA | 2492308 | A1 | 7/2006 |
| CA | 2594413 | C | 7/2006 |
| CA | 2594414 | C | 7/2006 |
| CA | 2559117 | A1 | 1/2008 |
| CA | 2650130 | A1 | 7/2009 |
| CA | 2678347 | | 2/2010 |
| CA | 2647088 | A1 | 6/2010 |
| CA | 2692204 | A1 | 8/2010 |
| CA | 2709241 | A1 | 1/2011 |
| CA | 2678348 | C | 3/2011 |
| CA | 2706399 | A1 | 11/2011 |
| CA | 2827655 | A1 | 9/2012 |
| CA | 2847742 | A1 | 12/2012 |
| CA | 2782308 | A1 | 1/2013 |
| CA | 2791318 | A1 | 4/2013 |
| CA | 2759356 | A1 | 5/2013 |
| CA | 2759357 | C | 5/2013 |
| CA | 2759362 | A1 | 5/2013 |
| CA | 2492306 | A1 | 7/2013 |
| CA | 2766844 | A1 | 8/2013 |
| CA | 2771703 | A1 | 9/2013 |
| CA | 2820702 | A1 | 12/2013 |
| CA | 2804521 | A1 | 7/2014 |
| CA | 2852542 | A1 | 11/2014 |
| CA | 2856914 | A1 | 1/2015 |
| CN | 1993534 | A | 7/2007 |
| CN | 101096590 | A | 1/2008 |
| CN | 201021612 | Y | 2/2008 |
| CN | 102758603 | A | 10/2012 |
| WO | 199967504 | | 12/1999 |
| WO | 199967505 | | 12/1999 |
| WO | 2005121504 | | 12/2005 |
| WO | WO 2006-074555 | A1 | 7/2006 |
| WO | WO 2008-060311 | A2 | 5/2008 |
| WO | 2009129449 | | 10/2009 |
| WO | WO 2010-092338 | A2 | 8/2010 |
| WO | WO 2010-101647 | A2 | 9/2010 |
| WO | 2012001008 | A1 | 1/2012 |
| WO | 2012119076 | | 9/2012 |
| WO | WO 2013-006950 | A2 | 1/2013 |
| WO | 2014028137 | | 2/2014 |
| WO | 2014035788 | | 3/2014 |

OTHER PUBLICATIONS

Aherne et al., "Fluid Movement in the SAGD Process: A Review of the Dover Project", Journal of Canadian Petroleum Technology, Jan. 2008.

Akram, "Reservoir Simulation Optimizes SAGD", American Oil & Gas Reporter (AOGR), Sep. 2010.

Alberta Chamber of Resources, "Oil Sands Technology Roadmap", Jan. 30, 2004, p. 27-32.

Alberta Energy, "Gas Over Bitumen Technical Solution—Technical Solution Roadmap", www.energy.alberta.ca, 2011.

Ashrafi et al., "Numerical Simulation Study of SAGD Experiment and Investigating Possibility of Solvent Co-Injection", Society of Petroleum Engineers, Jul. 19-21, 2011.

Asia Industrial Gases Association (AIGA), "Oxygen Pipeline Systems", 2005.

Balog et al., "The Wet Air Oxidation Boiler for Enhanced Oil Recovery", Journal of Canadian Petroleum, Sep.-Oct. 1982, p. 73-79.

Belgrave et al., "SAGD Optimization With Air Injection", Society of Petroleum Engineers, SPE 106901, Apr. 15-18, 2007.

Bennion et al., "The Use of Carbon Dioxide as Enhanced Recovery Agent for Increasing Heavy Oil", Joint Canada/Romania Heavy Oil Symposium, Mar. 3-7, 1993, p. 1-37.

(56) References Cited

OTHER PUBLICATIONS

Berkowitz, "Fossil Hydrocarbons", Academic Press, 1997.
Braswell, "New Heavy Oil Solvent Extraction Pilot to Test Experimental Process", Journal of Petroleum Technology Online, Jan. 9, 2012.
Brennan, "Screw Pumps Provide High Efficiency in Transport of Orinoco Bitumen", Pipeline & Gas Journal, vol. 222, Issue 3, Mar. 1995, p. 36-39.
Brigham et al., "In Situ Combustion", Chptr. 16, Reservoir Engineering, May 16, 2005.
Business Wire, "ELAN Energy Announces Nine Months Results", Nov. 1996.
Business Wire, "ELAN Energy Announces Six Months Results", Aug. 1996.
Butler, "Thermal Recovery of Oil and Bitumen", Prentice Hall, 1991, p. 4-15.
Canadian Association of Petroleum Producers (CAPP), "The Facts on Oil Sands", 2010.
Carcoana, "Enhanced Oil Recovery in Rumania", Society of Petroleum Engineers, SPE/DOE 10699, Apr. 4-7, 1982.
Chen et al., "Effects of Reservoir Heterogeneities on Steam-Assisted Gravity-Drainage Process", Society of Petroleum Engineers, V.11, No. 5, Oct. 2008.
Chen, "Assessing and Improving SAGD: Reservoir Homogeneities, Hydraulic Fractures and Mobility Control Foams" Stanford PhD Thesis, May 2009.
Chu, "A Study of Fireflood Field Projects", Journal of Petroleum Technology, Feb. 1977, p. 111-120.
Craig et al., "A Multipilot Evaluation of the COFCAW Process", Journal of Petroleum Technology, Jun. 1974, p. 659-666.
Dang et al., "Investigation of SAGD in Complex Reservoirs", SPE 133849-MS, Society of Petroleum Engineers, 2010.
Das, "Well Bore Hydraulics in a SAGD Well Pair", Society of Petroleum Engineers, 97922-MS, Nov. 1-3, 2005.
Dietz et al., "Wet and Partially Quenched Combustion", Journal of Petroleum Technology, Apr. 1968, p. 411-415.
Donaldson, et al., "Enhanced Oil Recovery II, Process and Operations", Chapter 11, Elsevier, 1989.
Dusseault, "Comparing Venesuelan and Canadian Heavy Oil and Tar Sands", Canadian Inst. Mining (CIM), Jun. 12-14, 2011.
Edmunds et al., "Economic Optimum Operating Pressure for SAGD Projects in Alberta", Journal of Canadian Petroleum Technology, V. 40, Dec. 2001, p. 13-17.
Elliot et al., "Computer Simulation of Single-Well Steam Assisted Gravity Drainage", U.S. Dept. of Energy Contract No. DE-FG22-96BC14994, Jul. 1999.
El-Sayed et al., "Horizontal Well Length: Drill Short or Long Wells?", Society of Petroleum Engineers, Nov. 18-20, 1996, p. 423-431.
Escobar, et al., "Optimization Methodology for Cyclic Steam Injection With Horizontal Wells", Society of Petroleum Engineers, Nov. 6-8, 2000.
Fadillah, "12 Oil Companies to Use EOR Methods to Boost Production", The Jakarta Post, Jun. 4, 2013.
Falk et al, "A Review of Insulated Concentric Coiled Tubing for Single Well, Steam Assisted Gravity Drainage (SWSAGD)", Society of Petroleum Engineers, Feb. 26-28, 1996.
Farouq Ali et al., "The Promise and Problems of Enhanced Oil Recovery Methods", Journal of Canadian Petroleum Technology, V. 35, No. 7, Sep. 1996, p. 57-63.
Fatemi et al., "Injection Well-Producer Well Combinations for Toe-to-Heel Steam Flooding (THSF)", Society of Petroleum Engineers, 140703-MS, May 23-26, 2011.
Fatemi et al., "Preliminary considerations on the application of toe-to-heel steam flooding (THSF): Injection well-producer well configurations", Chem. Eng. Res. & Design, V. 8, No. 11, 2011, p. 2365-2379.
Finan et al., "Nuclear Technology & Canadian Oil Sands: Integration of Nuclear Power with In-Situ Oil Extraction", MIT Thesis, Jun. 2007.
Frauenfeld et al., "Effect of an Initial Gas Content on Thermal EOR as Applied to Oil Sands", Journal of Petroleum Technology, Mar. 1988.
Gates et al., "In-Situ Combustion in the Tulare Formation, South Belridge Field, Kern County, California", Journal of Petroleum Technology, May 1978, p. 798-806.
Godin, "Clean Bitumen Technology Action Plan—From Strategy to Action", PTSC Water forum, May 16, 2011.
Greaves et al., "In Situ Combustion (ISC) Process Using Horizontal Wells", Journal of Canadian Petroleum Technology, vol. 35, No. 4, Apr. 1996, p. 49-55.
Greaves et al., "THAI—New Air Injection Technology", Society of Petroleum Engineers, Report 99-15, Jun. 14-18, 1995.
Green Car Congress, "Chevron Leveraging Information Technology to Optimize Thermal Production of Heavy Oil with Increased Recovery and Reduced Costs", Jun. 23, 2011.
Gutierrez et al., "The Challenge of Predicting Field Performance of Air Injection Projects Based on Laboratory and Numerical Modelling", Journal of Canadian Petroleum Technology, vol. 48, No. 4, Apr. 2009, p. 23-34.
Haggett et al., "Update 3-Long Lake Oil Sands Output May Lag Targets", Reuters, Feb. 10, 2011.
Halliburton, "Zonal Isolation for Steam Injection Applications", www.halliburton.com, 2010.
Hanzlik et al., "Forty Years of Steam Injection in California—The Evolution of Heat Management", Society of Petroleum Engineers, SPE 84848, Oct. 20-21, 2003.
Healing, "Petrobank Technology Earns Zero Grade", Calgary Herald, Mar. 10, 2012.
Heidrick et al., "Oil Sands Research and Development", Alberta Energy Research Inst., Mar. 2006.
Herbeck et al., "Fundamentals of Tertiary Oil Recovery", Energy Publications, 1977.
Herrera et al., "Wellbore Heat Losses in Deep Steam Injection Wells," The Society of Petroleum Engineers Regional Mtg., Apr. 12, 1978.
Hong et al., "Effects of Noncondensable Gas Injection on Oil Recovery by Steamflooding", Journal of Petroleum Technology, Dec. 1984.
Huygen et al., "Wellbore Heat Losses and Leasing Temperatures During Steam Injection", Apr. 1966, p. 25-32.
Improved Recovery Week, "Thermal System Ups Heavy Oil Flow; Lighter Crudes Eligible?", Dec. 4, 1995.
Integra Engineering Ltd., "Pushwater Systems Extend Heavy Oil Collection", 2011.
Ipek et al, "Numerical Study of Shale Issues in SAGD", Canadian Int'l Pet. Conf., Calgary, Jun. 17, 2008.
JACOS, "JACOS Hangingstone Expansion Project", www.jacos.com, Apr. 2010.
Jaremko, "Pressure Communication", Oilweek, Feb. 2006.
Javad et al., "Feasibility of In-Situ Combustion in the SAGD Chamber", Journal of Canadian Petroleum Technology, Jan. 27, 2011, p. 31-44.
Johnson et al., "Production Optimization at Connacher's Pod One (Great Divide) Oil Sands Project", Society of Petroleum Engineers, SPE Report No. 145091-MS, Jul. 19-21, 2011.
Jorshari, "Technology Summary", Journal of Canadian Petroleum Technology, 2011.
Kerr et al., "Sulphr Plant Waste Gasses: Incineration Kinetics and Fuel Consumption", Western Research & Development Ltd., Jul. 1975.
Kisman et al., "Development and Economic Application of Anti-Water Coning Methods to Alleviate a Widespread Problem", 5th Unitar Intl Conf. on Heavy Crude and Tar Sands, 1991, p. 279-287.
Kristoff et al., Winter Horizontal Well EOR Project, Phase III, Wascana Energy Inc., SRC Pub. No. P-110-436-C-99, Nov. 1999.
Kumar et al., "Cyclic Steaming in Heavy Oil Diatomite", Society of Petroleum Engineers, Mar. 8-10, 1995, p. 109-122.
Lai et al, "Factors Affecting the Application of Anti-Water Coning Technology (AWACT) at the South Jenner Oil Field, Southeast Alberta", Journal of Canadian Petroleum Technology, vol. 38, No. 3, Mar. 1999, p. 25-37.

(56) References Cited

OTHER PUBLICATIONS

Lake et al., "A Niche for Enhanced Oil Recovery in the 1990s", Oilfield Rev., Jan. 1992.
Lange, "Handbook of Chemistry", McGraw Hill, 1973.
Leung, "Numerical Evaluation of the Effect of Simultaneous Steam and Carbon Dioxide Injection on the Recovery of Heavy Oil", Society of Petroleum Engineers, Sep. 1983, p. 1591-1599.
Li et al, "Gas-Over-Bitumen Geometry and its SAGD Performance Analysis with Coupled Reservoir Gas Mechanical Simulation", Journal of Canadian Petroleum Technology, Jan. 2007, p. 42-49.
Li et al., "Numerical Investigation of Potential Injection Strategies to Reduce Shale Barrier Impacts on SAGD Process", Journal of Canadian Petroleum Technology, Mar. 2011, p. 57-64.
Liebe et al., Winter Horizontal Well EOR Project, Phase IV, Wascana Energy Inc., SRC Pub. No. P-110-606-C-02, Dec. 2002.
Lowey, "Bitumen Strategy Needs Better Grounding: EUB Study Offers Bad News for Athabasca Gas Producers", Business Edge, V. 4, No. 2, Jan. 15, 2004.
Luft, et al., "Thermal Performance of Insulated Concentric Coiled Tubing (ICCT) for Continuous Steam Injection in Heavy Oil Production.", Society of Petroleum Engineers, 37534-MS; Feb. 10-12, 1997.
Luhning et al., "The AOSTRA Anti Water Coning Technology (AWACT) Process—From Invention to Commercial Application", SPE Paper No. CIM/SPE 90-132, 1990, p. 132.1-132.8.
Luo et al., "Feasibility Study of CO2 Injection for Heavy Oil Reservoir After Cyclic Steam Simulation: Liaohe Oil Field Test", Society of Petroleum Engineers, Nov. 1-3, 2005.
Marufuzzanan, "Solubility and Diffusivity of Carbon Dioxide, Ethane, and Propane in Heavy Oil", University of Regina, M.A.Sc. Thesis, Nov. 2010.
McColl, "Nuclear Energy: Hedging Option for the Oil Sands", Nov. 2, 2006.
Moore et al., "In Situ Combustion Performance in Steam Flooded Heavy Oil Cores", Journal of Canadian Petroleum Technology, vol. 38, No. 13, 1999.
Moore et al., "Parametric Study of Steam Assisted In Situ Combustion", Final Report, vols. 1-2, 1994, p. 1-336.
Nasr, et al., "Thermal Techniques for the Recovery of Heavy Oil Bitumen", Society of Petroleum Engineers, Dec. 5-6, 2005.
New Technology Magazine, "EnCana Plans First Commercial Use of Solvent in New Oilsands Project", Nov. 2009, p. 10.
New Technology Magazine, "Excelsior Files Patent for ISC Process", www.newtechmagazine.com, Sep. 25, 2009.
New Technology Magazine, "Excelsior Searching for Joint Venture Partner for Hangingstone COGD Project", www.newtechmagazine.com, Nov. 20, 2009.
New York Times, Business Wire, "Ranger Oil in $408M Deal for Elan Energy", Sep. 3, 1997.
Nexen Inc., "Nexen Announces Second Quarter Results", Aug. 4, 2011.
N-solv Corporation, "Developing an In Situ Process for the Oilsands", 2012.
Oil & Gas Journal, "Self-Setting Thermal Packers Help Cyclic Steam", www.ogj.com Dec. 14, 1998.
Oil & Gas Journal, "Special Report: More US EOR Projects Start But EOR Production Continues Decline", Apr. 21, 2008.
Oilsands Quest, "Management Presentation", 2011.
Pacheco et al., "Wellbore Heat Losses and Pressure Drop in Steam Injection", The Journal of Petroleum Technology, Feb. 12, 1972, p. 139-144.
Parappilly et al., "SAGD With a Longer Wellbore", Journal of Canadian Petroleum Technology, V. 48, No. 6, Jun. 2009, p. 71-77.
Parrish et al., "Laboratory Study of a Combination of Forward Compustion and Waterflooding—The COFCAW Process", Journal of Petroleum Technology, Jun. 1969, p. 753-761.
Patton et al., "Carbon Dioxide Well Stimulation: Part 1—A Parametric Study", Journal of Petroleum Technology, Aug. 1982, p. 1798-1804.
Piers, "Coping With Water From Oil & Gas Wells", C-FER Technologies, Jun. 14, 2005.
Pooladi-Darvish et al., "SAGD Operations in the Presence of Underlying Gas Cap and Water Layer-Effect of Shale Layers", Journal of Canadian Petroleum Technology, V. 41, No. 6, Jun. 2002.
Prats et al., "In Situ Combustion Away From Thin, Horizontal Gas Channels", Society of Petroleum Engineers Journal, Mar. 1968, p. 18-32.
Ramey, "In Situ Combustion", Proc. 8th World Pet. Long., 1970, p. 253-262.
Roche, "Beyond Steam", New Technology Magazine, Sep. 2011.
Roche, "No Analogue", New Technology Magazine, Apr. 2009, p. 10.
Ross, "Going the Distance", New Technology Magazine, Dec. 2008, p. 34.
Ross, "Injecting Air Replaces Gas in Depleted Gas Over Bitumen Reservoir", New Technology Magazine, May 2009, p. 34-46.
Saltuklaroglu et al., "Mobil's SAGD Experience at Celtic, Saskatchewan", SPE, 99-25, 1999, p. 45-51.
Sarathi, "In-Situ Combustion Handbook—Principals and Practices", Report Prepared for U.S. Department of Energy, Jan. 1999.
Sarkar et al., "Comparison of Thermal EOR Processes Using Combinations of Vertical and Horizontal Wells", Society of Petroleum Engineers, SPE 25793 Feb. 8-10, 1993, p. 175-181.
Satter, "Heat Losses During Flow of Steam Down a Wellbore", The Journal of Petroleum Technology, Jul. 1965, p. 845-851.
Schindelar et al., Mideast Heavy Oil Pilot Delivers for Chevron, The Daily Oil, Oct. 21, 2010.
Schlumberger Ltd., www.slb.com, "Packer Systems", May 2012.
Shin et al., "Shale Barrier Effects on SAGD Performance", Society of Petroleum Engineers, SPE 125211-MS, Oct. 19-21, 2009.
Shore, "Making the Flare Safe", Journal of Loss Prevention in the Process Industries, V.9, No. 6, 1996, p. 363-381.
Singhal et al., "A Mechanistic Study of Single-Well Steam Assisted Gravity Drainage", SPE, 59333-MS, Apr. 3-5, 2000.
Stalder, "Cross-SAGD (XSAGD)—An Accelerated Bitumen Recovery Alternative", Society of Petroleum Engineers, V. 10, No. 1, Nov. 1-3, 2005.
Stevens et al., "A Versatile Model for Evaluating Thermal EOR Production Economics", Society of Petroleum Engineers, No. 1998. 113, 1998.
Stockwell et al., "Transoil Technology for Heavy Oil Transportation: Results of Field Trials at Wolf Lake", Society of Petroleum Engineers, 1988, p. 248-258.
Stone et al., "Flares", Chptr. 7, www.gasflare.org, Dec. 1995, p. 7.1-7.44.
Stone et al., "Flares", Chptr. 7, www.gasflare.org, Dec. 2012, p. 7.1-7.44.
Tan et al., "Application of a Thermal Simulator with Fully Coupled Discretized Wellbore Simulation to SAGD", Journal of Canadian Petroleum Technology, vol. 41, No. 1, 2002, p. 25-30.
Tavallali, "Assessment of SAGD Well Configuration Optimization in Lloydminster Heavy Oil Reserve", Society of Petroleum Engineers, SPE 153128, Mar. 20-22, 2012.
Thimm et al., "A Statistical Analysis of the Early Peace River Thermal Project Performance", Journal of Canadian Petroleum Technology, V. 32, No. 1, Jan. 1993.
Thomas, "Enhanced Oil Recovery—An Overview", Oil & Gas Science & Technology, V. 63, No. 1, 208, p. 9-19.
Triangle Three Engineering, "Technical Audit Report—Gas Over Bitumen Technical Solutions", 2010.
Turta et al., "Preliminary Considerations on Application of Steamflooding in a Toe-to-Heel Configuration", 130444-PA, Journal of Canadian Petroleum Technology, V. 48, No. 11, Nov. 2009.
U.S. Department of Energy, "Enhanced Geothermal Systems—Wellfield Construction Workshop", San Francisco, Oct. 16, 2007.
U.S. Environmental Protection Agency, "Industrial Flares", www.epa.gov/ttn/chief/ap42/ch13/final/c13s05.pdf, Jun. 2012.
Vanderklippe, "Long Lake Project Hits Sticky Patch", The Globe and Mail, Feb. 10, 2011.
Walley, Middle East Enhanced Oil Recovery, www.arabianoilandgas.com, May 5, 2011.
Wikipedia, "Orimulsion", 2013.

(56) References Cited

OTHER PUBLICATIONS

Willhite et al., "Wellbore Refluxing in Steam Injection Wells", Journal of Petroleum Technology, Mar. 1987,, p. 353-362.
www.lloydministerheavyoil.com, "Completions and Workovers", 2012.
Xinhua's China Economic Information Service, "China's First Orimulsion Pipeline Comes on Steam", Nov. 7, 2006.
Yang et al., "Combustion Kinetics of Athabasca Bitumen From ID Combustion Tube Experiments", Int'l Assoc. for Mathematical Geology, Sep. 2009, p. 193-211.
Yang et al., "Design and Optimization of Hybrid Ex Situ / In Situ Steam Generation Recovery Processes for Heavy Oil and Bitumen", Canadian Heavy Oil Association, SPE 117643, Oct. 20-23, 2008.
Yang et al., "Design of Hybrid Steam—In Situ Combustion Bitumen Recovery Process", 2009, p. 213-223.
Yang et al., "The Design of Hybrid Steam-In Situ Combustion Bitumen Recovery Processes", Proceedings of the Canadian Int'l Petroleum Conference/SPE Gas Technology Symp. Joint Conference, Paper 2008-114, Jun. 17-19, 2008.
Zawierucha et al., Material Compatibility and Systems Considerations in Thermal EOR Environments Containing High-Pressure Oxygen, Journal of Petroleum Technology, Nov. 1988, p. 1477-1483.
Official Action for U.S. Appl. No. 13/628,164, dated Mar. 13, 2014, 7 pages.
Notice of Allowance for U.S. Appl. No. 13/628,164, dated Sep. 26, 2014, 8 pages.
U.S. Appl. No. 14/582,819, filed Dec. 24, 2014, Kerr.
Restriction Requirement for U.S. Appl. No. 13/543,012, dated Aug. 11, 2014, 6 pages.
Official Action for U.S. Appl. No. 13/543,012, dated Oct. 3, 2014, 28 pages.
State Intellectual Property Office, Second Office Action for CN Application No. 201280034449.9 dated Aug. 8, 2016.
United States Patent and Trademark Office, Office Action dated Feb. 26, 2015, issued in U.S. Appl. No. 14/058,488.
United State Patent and Trademark Office, Office Action dated Mar. 6, 2015, issued in U.S. Appl. No. 14/078,983.
United States Patent and Trademark Office, Office Action dated Apr. 9, 2015, issued in U.S. Appl. No. 13/888,874.
United States Patent and Trademark Office, Office Action dated Apr. 10, 2015, issued in U.S. Appl. No. 13/889,775.
United States Patent and Trademark Office, Office Action dated Jul. 17, 2015, issued in U.S. Appl. No. 13/543,012.
USPTO, Office Action for U.S. Appl. No. 14/083,106 dated Nov. 19, 2015.
USPTO, Office Action for U.S. Appl. No. 13/893,902 dated Sep. 3, 2015.
USPTO, Office Action for U.S. Appl. No. 13/893,902 dated Apr. 21, 2016.
USPTO, Office Action for U.S. Appl. No. 14/104,711 dated Nov. 18, 2015.
USPTO, Office Action for U.S. Appl. No. 14/058,488 dated Nov. 5, 2015.
USPTO, Office Action for U.S. Appl. No. 14/582,819 dated Aug. 11, 2015.
USPTO, Office Action for U.S. Appl. No. 13/928,839 dated Oct. 22, 2015.
USPTO, Office Action for U.S. Appl. No. 13/628,178 dated Aug. 21, 2015.
USPTO, Office Action for U.S. Appl. No. 13/628,178 dated Feb. 23, 2016.
State Intellectual Property Office of China, Office Action for CN Application No. 201280034449.9 dated Oct. 10, 2015.
State Intellectual Property Office of China, Patent Search Report for CN Application No. 201280034449.9 dated Sep. 25, 2015.
USPTO, Office Action for U.S. Appl. No. 13/543,012 dated Aug. 10, 2016.
USPTO, Office Action for U.S. Appl. No. 13/543,012 dated Nov. 24, 2015.
USPTO, Office Action for U.S. Appl. No. 14/099,472 dated Mar. 2, 2015.

* cited by examiner

SAGD WELL CONFIGURATION

SAGD STAGES

1) Early Life (immature process)
- Productivity from ceiling drainage and steep slope drainage
- Slope drainage is dominant (LinDrain Equation) (BUTLER, 1991)
- Growth both lateral and upwards

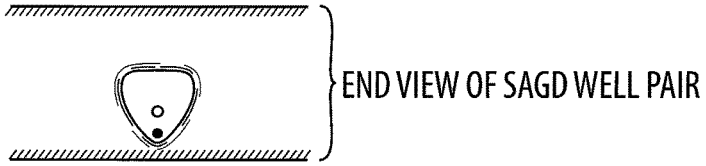

2) Mature
- Peak productivity when GD chamber hits the OB ceiling
- Wall slope starts to flatten as chamber starts to grow laterally

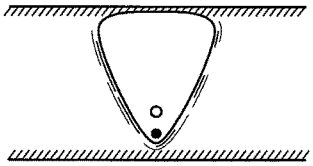

3) Old Age
- Productivity from ceiling drainage stops
- Heat loss to OB ceiling is significant
- Decreased wall slope reduces productivity
- Nearby well pairs may be in communication

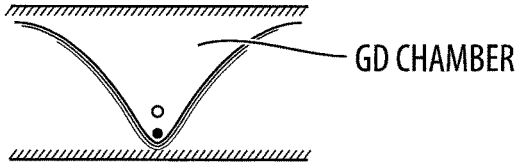

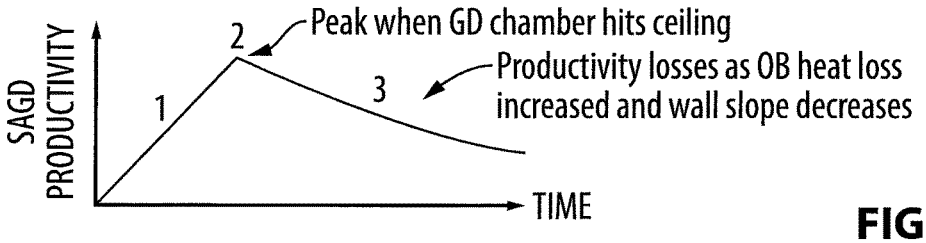

FIG.2

SATURATED STEAM PROPERTIES

BITUMEN + HEAVY OIL VISCOSITIES

SAGD HYDRAULIC LIMITS

SAGD WITH TOP GAS

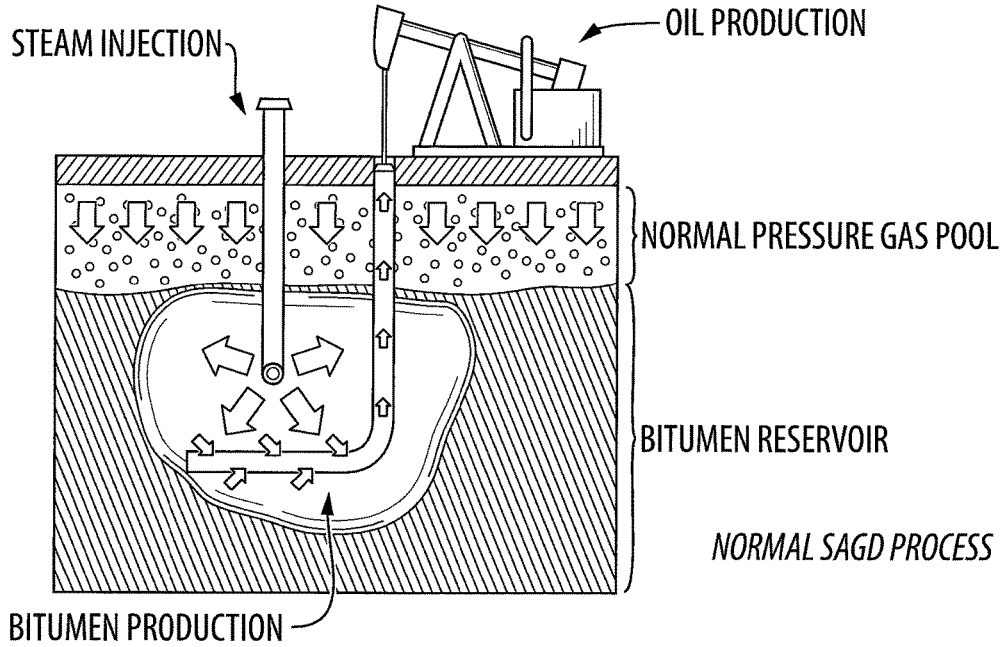
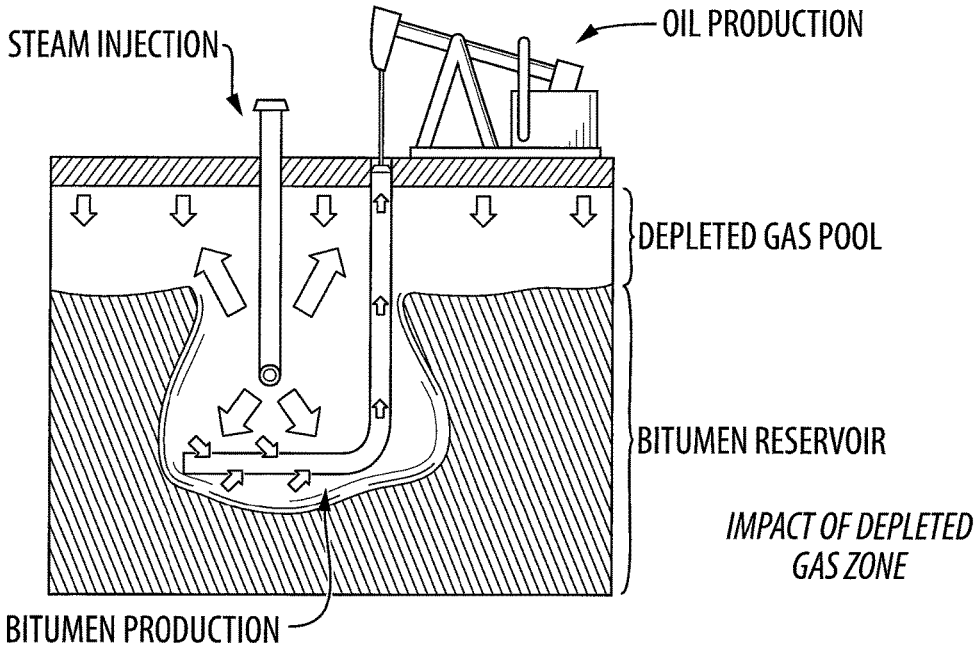
TOP GAS IMPACT ON SAGD
SOURCE: ALBERTA (2011)
FIG.7

SOURCE: WOOLEY (2005)

GAS OVER BITUMEN IN ALBERTA

GAS OVER BITUMEN TECHNICAL SOLUTION ROADMAP:
*A TECHNICAL SOLUTION WHICH OPTIMIZES GAS & BITUMEN RECOVERY*

SOURCE: ALBERTA ENERGY, WEBSITE, 2011

INTERSPERSED BITUMEN LEAN ZONES

TOP/BOTTOM WATER: OILSANDS

SAGDOX WITH INTERSPERSED WLZ

Effective horizontal and vertical permeability as a function of shale content sandstone permeability = 3000mD, shale permeability = 0.1mD

THE EFFECT OF DISCONTINUOUS SHALES ON RESERVOIR PERMEABILITY

SOURCE: POOLADI-DARVISH (2002)

SAGDOX

SAGDOX WITH TOP GAS

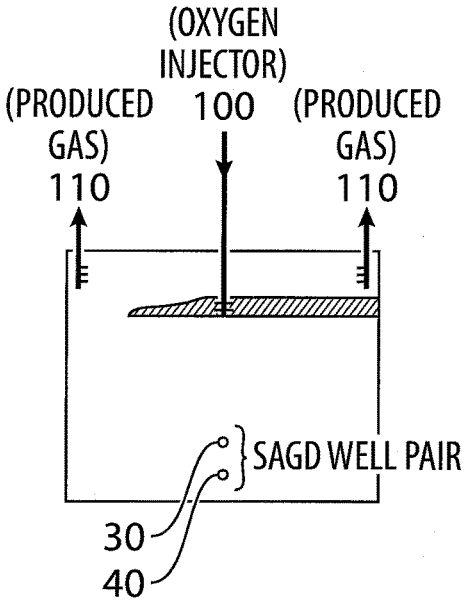
DISCONTINUOUS WLZ - *PATTERN END VIEW*
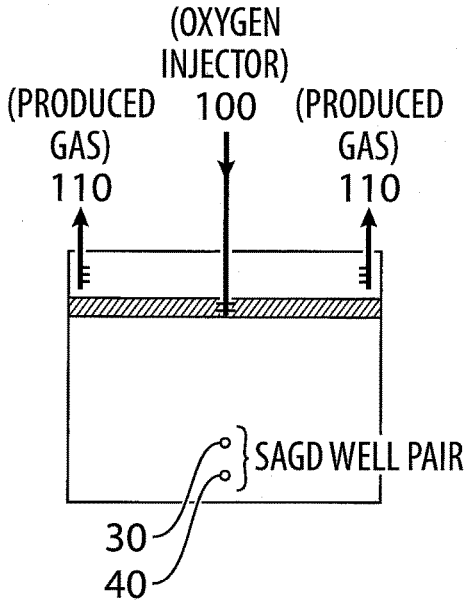
CONTINUOUS WLZ - *PATTERN END VIEW*
PLACEMENT OF SAGDOX, $O_2$ INJECTOR IN A WLZ RESERVOIR
FIG.16

KEY ASSUMPTION:

1. 6MMBTU/bbl HEATING VALUE OF BITUMEN
2. 1000BTU/lb HEAT DEMAND TO VAPORIZE WATER
3. NO HEAT DEMAND FOR MATRIX HEATING

WATER LEAN ZONE (WLZ) BITUMEN RECOVERY

RESIDUAL BITUMEN IN STEAM-SWEPT ZONES
SOURCE: CIM 97 - 137, R. BUTLER (1997)

PLACEMENT OF SAGDOX, $O_2$ INJECTOR IN A SHALEY RESERVOIR (DISCONTINUOUS SHALES)

SAGDOX: MULTIPLE LIMITED SHALE BARRIERS

PLACEMENT OF SAGDOX, $O_2$ INJECTOR AND PG VENT WELLS FOR A CONTINUOUS SHALE BARRIER

SAGDOX GEOMETRY FOR IMPAIRED BITUMEN RESERVOIRS

BACKGROUND OF THE INVENTION

The Athabasca bitumen resource in Alberta, Canada is one of the world's largest deposits of hydrocarbons. The leading EOR process for in situ recovery of bitumen is SAGD. But the reservoir quality is often impaired by top gas (gas over bitumen), top water (water over bitumen), water lean zones, bottom water (water under bitumen), shale and/or mudstone deposits (barrier or baffle), thin pays, and bitumen quality gradients, (i.e. reservoir inhomogeneities).

The Athabasca bitumen resource in Alberta, Canada is unique for the following reasons:

(1) The resource, in Alberta, contains about 2.75 trillion bbls. of bitumen (Butler, R. M., "Thermal Recovery of Oil & Bitumen", Prentice Hall, 1991), including carbonate deposits. This is one of the world's largest liquid hydrocarbon resources. The recoverable resource, excluding carbonate deposits, is currently estimated as 170 billion bbls. split at 20% mining (43 billion bbls.) and 80% in situ EOR (136 billion bbls.) (CAPP, "The Facts on Oil Sands", November, 2010). The in situ EOR estimate is based on SAGD, or a similar process.

(2) Conventional oil reservoirs have a top seal (cap rock) that prevents oil from leaking and traps (contains) the resource. Bitumen is formed by bacterial degradation of a lighter source oil to a stage where the degraded bitumen is immobile, under reservoir conditions. Bitumen reservoirs may be usually self-sealed (no cap rock seal). If an in situ EOR process hits the top of the bitumen zone (ceiling), the process may not be contained, and the bitumen may easily be contaminated by water or gas from above the bitumen.

(3) Bitumen density is close to the density of water or brine. Some bitumens are more dense than water; some are less dense than water. During the bacterial-degradation and thus formation of bitumen, the hydrocarbon density may pass through a density transition and water may, at first, be less dense but become more dense than bitumen. Bitumen reservoir water zones are found above the bitumen (top water), below the bitumen (bottom water), or interspersed in the bitumen net pay zone (water lean zones (WLZ)).

(4) Most bitumen was formed in a fluvial or estuary environment. With a focus on reservoir impairments, this has 2 consequences. First, there will be numerous reservoir inhomogeneities. Second, the scale of the inhomogeneities is likely to be less than the scale of the SAGD recovery pattern (see FIG. 1) or less than about 1000 m in size. The expectation is that a SAGD EOR process will encounter several inhomogeneities within each recovery pattern.

Today's leading in situ EOR process to recover bitumen from Canada's oil sands is SAGD (Steam Assisted Gravity Drainage). The current estimate of recoverable bitumen using in situ EOR is 136 billion bbls (CAPP (2010)). This is one of the world's largest, recoverable liquid hydrogen resources in the world.

SAGD is a delicate process. Temperatures and pressures are limited by saturated steam properties. Gravity drainage is driven by a pressure differential as low as 25 psia. Low temperatures (in a saturated steam process) and low pressure gradients make the SAGD process susceptible to impairments from reservoir inhomogeneities, as above.

SAGDOX is a more robust process. Because of the combustion component, at equal pressures, temperatures may be higher than saturated-steam temperatures. SAGDOX geometry (i.e. well locations) may compensate for some of the reservoir impairments that affect SAGD.

This invention describes how SAGDOX wells may be drilled and completed to ameliorate damages due to reservoir inhomogeneities as discussed above.

SUMMARY OF THE INVENTION

The following acronyms will be used herein.

AOGR American Oil & Gas Reporter
CAPP Canadian Association of Petroleum Producers
CIM Canadian Institute of Mining
CMG Computer Modeling Group
CSS Cyclic Steam Stimulation
D Permeability, Darcies
EnCAID Encana Air Injection Displacement
EOR Enhanced Oil Recovery
ERCB Energy Resources Conservation Board
ESP Electric Submersible Pump
ETOR Energy to Oil Ratio (MMBTU/bbl)
GD Gravity Drainage
HTO High Temperature Oxidation
IBR Impaired Bitumen Reservoirs
ISC In Situ Combustion
JCPT Journal of Canadian Petroleum Technology
LLK Long Lake (Alberta)
LTO Low Temperature Oxidation
OB Over Burden
P Pressure
PG Produced (non-condensable) Gas
PSC Petroleum Society of Canada
SAGD Steam Assisted Gravity Drainage
SAGDOX SAGD with Oxygen
SAGP Steam and Gas Push
SOR Steam to Oil Ratio
SPE Society of Petroleum Engineers
STARS Steam Thermal Advanced Reservoir Simulator
T Temperature
WLZ Water Lean Zone According to one aspect of the invention, there is provided a process to utilize at least one water lean zone (WLZ) interspersed within a net pay zone in a reservoir and produce bitumen from said reservoir, wherein:

(i) SAGDOX is used to enhance oil recovery;
(ii) the WLZ is interspersed within the net pay zone of said reservoir;
(iii) a SAGDOX oxygen injector is proximate the WLZ, preferably in the WLZ; and
(iv) non-condensable gases are removed in a separate well.

According to another aspect of the invention, there is provided a process to accelerate breaching of at least one discontinuous shale barrier or baffle zone, proximate a bitumen pay zone, compared to saturated steam (e.g. SAGD), in bitumen reservoirs, wherein:

(i) SAGDOX is used to enhance oil recovery;
(ii) said at least one shale barrier or baffle zone is located within the bitumen pay zone;
(iii) a SAGDOX oxygen injector is proximate said at least one shale barrier or baffle, preferably underneath said at least one shale barrier or baffle; preferably proximate the center of said at least one shale barrier or baffle;
(iv) any poor conformance created by moving the SAGDOX oxygen injector to an off-center location is partially compensated by controlling produced gas vent rates using at least one produced gas vent well, preferably two produced gas vent wells, wherein said produced gas is non-condensable.

According to yet another aspect of the invention, there is provided a process to breach at least one continuous shale barrier zone in a bitumen reservoir having a net pay zone, wherein:

(i) SAGDOX is used to enhance oil recovery;

(ii) said at least one shale barrier zone is located within the bitumen net pay zone;

(iii) a SAGDOX oxygen injector proximate the center of said at least one shale barrier; preferably said SAGDOX oxygen injector is completed above and below said at least one shale barrier zone; and (iv) at least one produced gas vent well proximate pattern boundaries of said at least one shale barrier zone; preferably said at least one produced gas vent well is completed above and below the shale barrier zone.

According to another aspect of the invention, there is provided a process to increase bitumen production in a bitumen reservoir that has top gas with a pressure, wherein:

(i) SAGDOX is used for enhancing oil recovery;

(ii) SAGDOX pressure is adjusted to match (±10%) of said top gas pressure; and (iii) non-condensable combustion gas inventory is controlled by at least one produced gas vent well, preferably a plurality of produced gas vent wells, to maximize horizontal growth rates of the gravity drainage chamber of the SAGDOX; preferably to also minimize vertical growth rates.

According to another aspect of the invention, there is provided a process to increase bitumen production, compared to SAGD, in a bitumen reservoir that has an active bottom water with a pressure, where:

(i) SAGDOX is the process used for enhanced oil recovery;

(ii) SAGDOX pressure is adjusted to match said active bottom water pressure, preferably between (±10%) of said active bottom water pressure.

According to yet another aspect of the invention, there is provided a process to increase bitumen production, compared to SAGD, in a bitumen reservoir that has an active top water with a pressure, where:

(i) EOR process is SAGDOX (ii) SAGDOX pressure is chosen/adjusted to substantially match top water pressure, preferably (±10%)

(iii) non-condensable gas inventory in the gravity drainage chamber is controlled by at least one produced gas vent well, preferably a plurality of produced gas vent wells, to minimize vertical gravity drainage growth rates.

According to yet another aspect of the invention, there is provided a process to produce bitumen from a bitumen reservoir with net pay less than 15 m wherein:

(i) EOR process is SAGDOX;

(ii) SAGDOX has an oxygen/steam (v/v) ratio from 0.5 to 1.0.

According to another aspect of the invention, there is provided a process to increase bitumen production, compared to SAGD, in a bitumen reservoir having a bottom-zone and a top-zone; each of said bottom-zone and said top-zone bitumen have a viscosity, said bitumen reservoir has a significant vertical bitumen quality (i.e. viscosity) gradient, wherein:

(i) the bottom-zone bitumen viscosity is greater than the top-zone viscosity, preferably more than double the top-zone viscosity; and (ii) EOR process is SAGDOX.

Preferably the barrier or baffle zone is comprised of mudstone, shale, or a mixture of mudstone and shale.

Preferably, the barrier or baffle zone comprises multiple barrier or baffle zones, preferably within a single SAGDOX production pattern.

Preferably, multiple oxygen injector wells are used to access/utilize each barrier or baffle zone.

Preferably the bitumen to be processed has a density <10 API and in situ viscosity >100,000 cp.

Preferably the SAGDOX process has an oxygen injection rate such that the ratio of oxygen/steam (v/v) is between 0.5 and 1.0.

BRIEF DESCRIPTION OF THE DRAWINGS

FIG. 2 depicts SAGD Stages

FIG. 7 depicts the Top Gas Impact on SAGD

FIG. 16 depicts Placement of SAGDOX, $O_2$ injector in a WLZ Reservoir according to one embodiment of the present invention

DETAILED DESCRIPTION OF THE INVENTION

Figure 1:
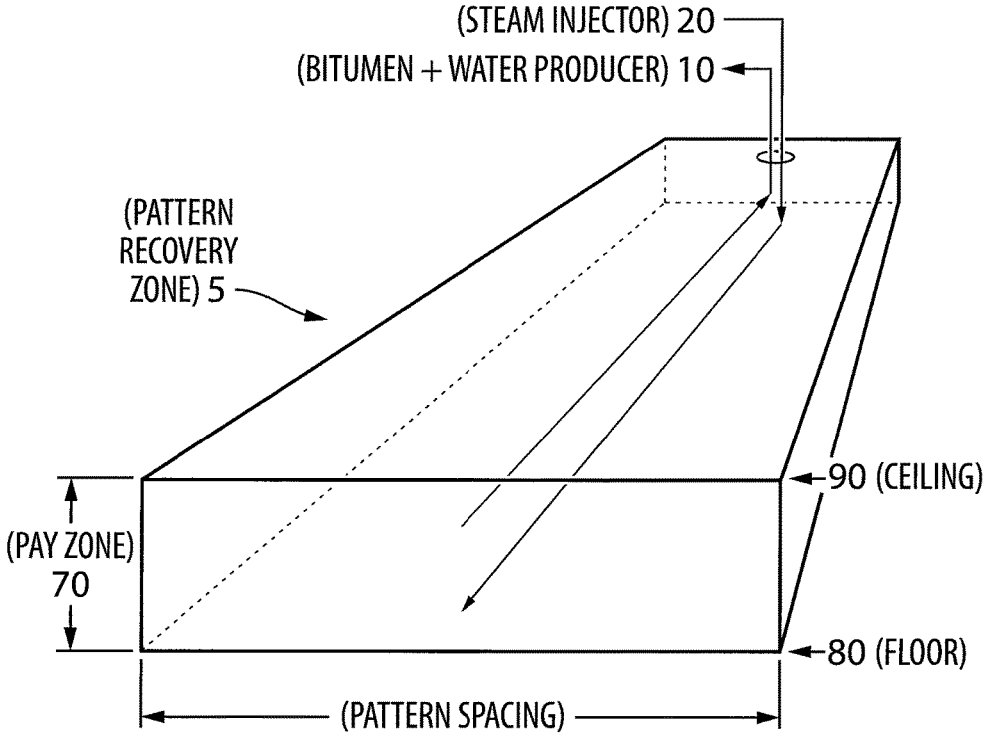
FIG. 1 depicts a prior art SAGD Well Configuration

SAGD is a bitumen EOR process that uses saturated steam to deliver energy to a bitumen reservoir. FIG. 1 shows the basic prior art SAGD geometry, using twin, parallel horizontal wells (10, 20) (up to about 2 to 8 meters above the bottom of the bitumen zone (floor)). The upper well (20) is in the same vertical plane and injects saturated steam into the reservoir (5). The steam heats the bitumen and the reservoir matrix. As the interface between steam and cold bitumen moves outward and condensed steam drains, by gravity, to the lower horizontal well (10) that produces the liquids. The heated liquids (bitumen+water) are pumped (or conveyed) to the surface using ESP pumps or a gas-lift system.

FIG. 2 shows how SAGD matures. A young steam chamber (1) has bitumen drainage from steep sides and from the chamber ceiling. When the chamber grows (2) and hits the top of the net pay zone, drainage from the chamber ceiling stops and the slope of the side walls decreases as the chamber continues to grow outward. Bitumen productivity peaks at about 1000 bbls/d, when the chamber hits the top of the net pay zone and falls as the chamber grows outward (3), until eventually (10-20 years.) the economic limit is reached.

Since the produced fluids are at/near saturated steam temperatures, it is only the latent heat of the steam that contributes to the process (in the reservoir). It is important to ensure that steam is high quality as it is injected into the reservoir.

A SAGD process, in a good homogeneous reservoir, may be characterized by only a few measurements:

(1) Saturated steam T (or P)

(2) Bitumen production rate (one key economic factor), and (3) SOR—a measure of process efficiency For an impaired reservoir, a fourth measurement is added—the water recycle ratio (WRR) enables one to see how much of injected steam is returned as condensed water. WRR is the volume ratio, measured as liquid water, of water produced to steam injected.

SAGD operation, in a good-quality reservoir, is straightforward. Steam injection rate into the upper horizontal well and steam pressure, are controlled by pressure targets chosen by the operator. If the pressure is below the target, steam pressure and injection rates are increased. The opposite is done if pressure is above the target. Production rates from the lower horizontal well are controlled to achieve sub-cool targets as the difference between the average temperature of saturated steam, at reservoir conditions, and the actual temperature of produced liquids (bitumen+water). Produced fluids are kept at lower T than saturated steam to ensure that live steam doesn't get produced. 20° C. is a typical sub-cool target. This is also called steam-trap control.

Figure 3:
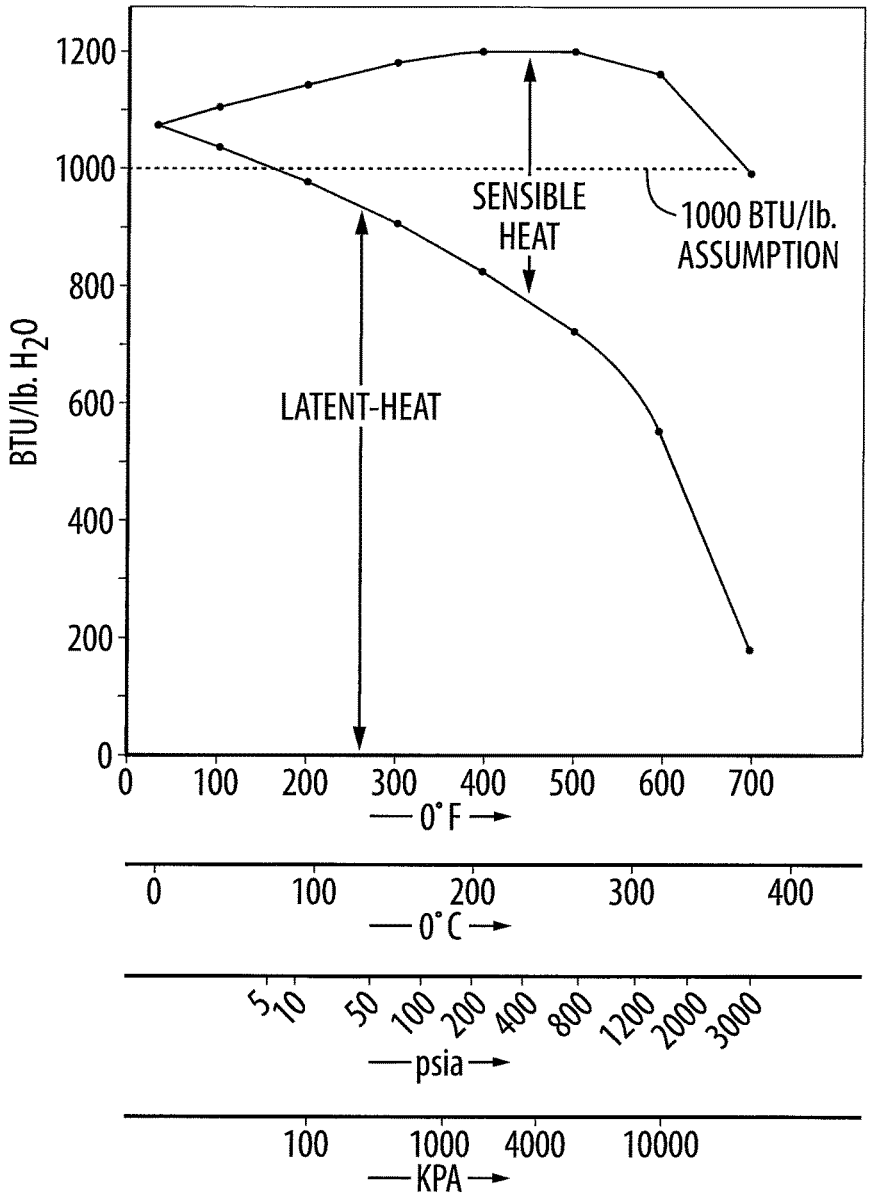
FIG. 3 depicts Saturated Steam Properties
Figure 4:
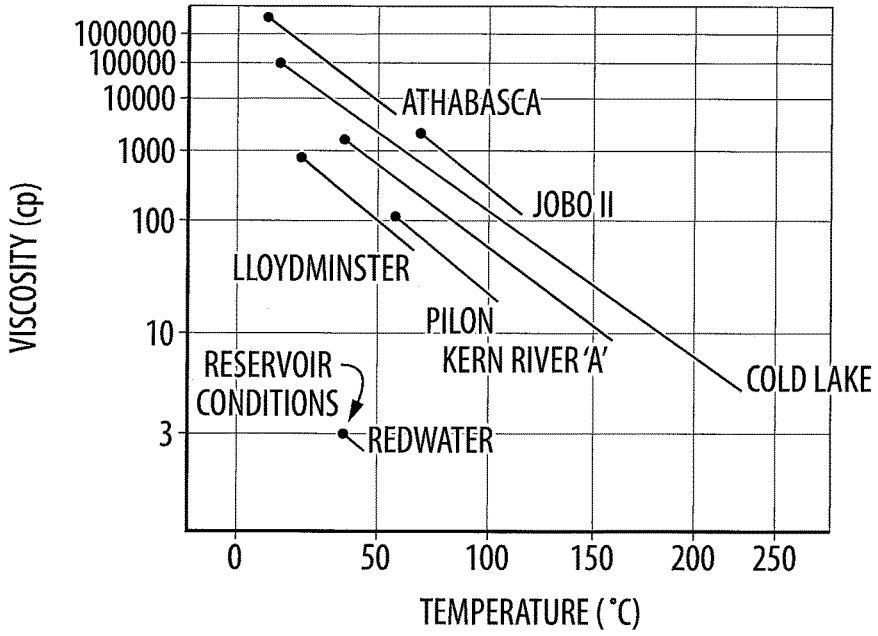
FIG. 4 depicts Bitumen+Heavy Oil Viscosities

The SAGD operator has two choices to make—the sub-cool target and the operating pressure of the process. Operating pressure may be more important. The higher the pressure, the higher the steam temperature linked by the properties of saturated steam (FIG. 3). As operating temperature rises, so does the temperature of the heated bitumen, which, in turn, reduces bitumen viscosity. Bitumen viscosity is a strong function of temperature. FIG. 4 depicts various bitumen recovery sites and the relation of bitumen viscosity versus operating temperature of bitumen from various sites. The productivity of a SAGD well pair is proportional to the square root of the inverse bitumen viscosity (Butler (1991)). So the higher the pressure, the faster the recovery of bitumen—a key economic performance factor.

But, efficiency is lost if pressures are increased. It is only the latent heat of steam that contributes (in the reservoir) to SAGD. As one increases steam pressure (P) and temperature (T) to improve productivity, the latent heat content of steam drops (FIG. 3). In addition, as one increases P, T, one requires more energy to heat the reservoir matrix up to saturated steam T, so that heat losses increase (SOR and ETOR increase).

The SAGD operator usually opts to maximize economic returns and increases P, T as much as possible. Pressures are usually much greater than native reservoir P. A few operators have gone too far and exceeded parting pressures (fracture pressure) and caused a surface breakthrough of steam and sand (Roche, P. "Beyond Steam", New. Tech. Mag., September, 2011).

Figure 5:
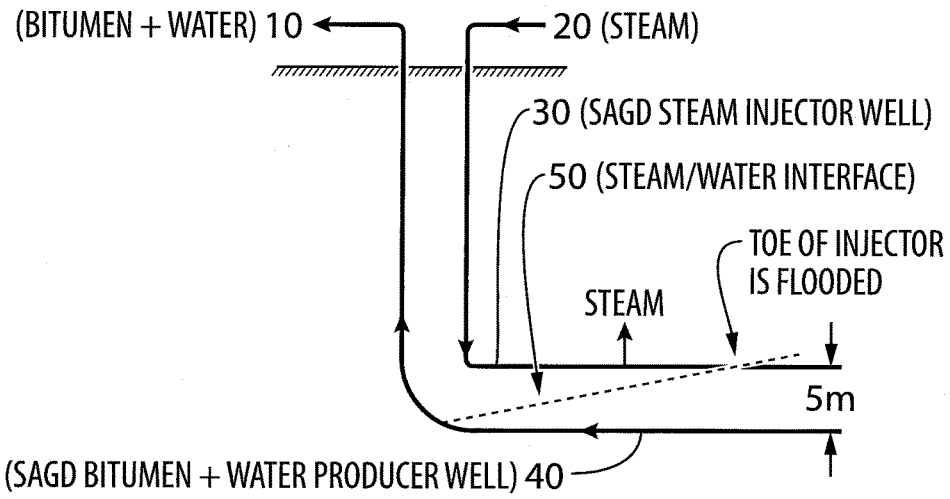
FIG. 5 depicts SAGD Hydraulic Limits

There also may be a hydraulic limit for SAGD, as best seen in FIG. 5. The hydrostatic head between the two SAGD wells (10, 20) is about 8 psia (56 kPa). When pumping or producing bitumen and water (10), there is a natural pressure drop in the well due to frictional forces. If this pressure drop exceeds the hydrostatic head, the steam/liquid interface (50) may be "tilted" and intersect the producer or injector well (10, 20). If the producer (10) is intersected, steam may break through. If the injector (20) is intersected, it may be flooded and effective injector length may be shortened. For current standard pipe sizes and a 5 m spacing between wells (10, 20), SAGD well lengths are limited to about ≤1000 m due to this limitation.

One of the common remedies for an impaired SAGD reservoir, that has water incursion, is to lower the SAGD operating pressures to match native reservoir pressure—also called low-pressure SAGD. This is difficult at best, and impractical at its worst for the following reasons:

(1) There is a natural hydrostatic pressure gradient in the net pay region. For example, for 30 m of net pay the hydrostatic head is about 50 psi (335 kPa). Because the steam chamber is a gas, it is at constant pressure. What pressure does one choose to match reservoir P?

(2) There are also lateral pressure gradients in SAGD. The pipe size for the SAGD producer is chosen so that the natural pressure gradient, when pumping is less than the hydrostatic pressure difference between SAGD steam injector and bitumen producer (about 8 psia or 56 kPa). How can one match SAGD P to reservoir P if one has a lateral pressure gradient?

(3) Pressure control for SAGD is difficult and measurements are inexact. A pressure control uncertainty of ±200 kPa is to be expected.

The template bitumen EOR process as discussed above is SAGD. SAGD is now the dominant bitumen EOR process. Ideally, SAGD works best for homogeneous bitumen reservoirs with clean sand, high bitumen saturation, high permeability (particularly in the vertical direction) and high porosity. But, Athabasca sand reservoirs have several impairments compared to the ideal expectation, including (but not limited to) the following:

(1) Top Gas—Also referred to as gas-over-bitumen is a gas-saturated zone on top of the bitumen reservoir (or linked to the bitumen reservoir by an active top water zone). It has been reported that about a third of the area of the oil sands has both oil sands (bitumen) reservoirs and overlying gas pools (FIG. 3) (Li, P. et al, "Gasover Bitumen Geometry and its SAGD Performance Analysis with Coupled Reservoir Gas Mechanical Simulation", JCPT, January, 2007). It has also been reported that, for the oils sands area, about 60% of the gas pools are connected to bitumen deposits (Lowey, M., "Bitumen Strategy Needs Better Grounding, Business Edge, Jan. 15, 2004). So, if we take both these reports at face value, about 20% of the oil sands, by area, has top gas connected to bitumen reservoirs. This may understate the size of the issue. In a separate study, it was estimated that 40% of the area of the oil sands (McMurray Formation) includes top gas that may be connected to underlying bitumen.

(2) Water Lean Zones (WLZ)—Zones in a hydrocarbon reservoir where bitumen saturation is significantly reduced compared to the bitumen pay zone. For the purpose herein we define WLZ as <50% (v/v) bitumen saturation in the reservoir pore volume. These zones may either be "active" (>50 $m^3$/d water recharge rate) or "limited" (<50 $m^3$/d water recharge rates).

(3) Top/Bottom Water—Depending on bitumen and water density (and historical densities as bitumen was produced by bacterial degradation of oil), zones of high water saturation (>50% (v/v)) may exist directly above (top water) or directly below (bottom water) the bitumen pay zone. These zones are usually "active", with high recharge rates.

(4) Shale/Mudstone—Shale is a fine-grained, clastic sedimentary rock composed of mud that is a mix of flakes of clay minerals and tiny fragments (silt-sized particles). Shale is generally impermeable and fissile (thin layers). Black shale contains greater than 1% carbaceous material and it is indicative of a reducing environment (i.e. oil reservoir). Clays, including kaolinite, montmorillonite and illite are the major constituents of most shale. Mudstone is a related material, with the same solid constituents as shale, but with much more water and no fissility. Mudstone has a very low permeability.

Shale and mudstone form two kinds of reservoir impairments—1) baffles are shale/mudstone streaks, within the pay zone but with only limited areal extent; 2) barriers are more extensive shale/mudstone layers, with the same scale as a SAGD recovery pattern (i.e. $>10^5$ $m^2$).

The Athabasca bitumen resource (McMurray Formation) contains, on average about 20 to 40% (v/v) shale and mudstone. Commercial operators high-grade the resource to areas with much less impairment by shale and/or mudstone. But any process for in situ recovery, for the bulk of the resource, must deal with significant shale and mudstone concentrations.

(5) Thin Pay—Mostly on the peripheries of the Athabasca bitumen deposit, the bitumen pay zone may be thin and not within the economic limit for SAGD (i.e. <15*m* thick).

(6) Bitumen Quality Gradients—Because bitumen was created by biological degradation, the bitumen near the bottom of the bitumen reservoir is usually of significantly reduced quality (lower API, increased viscosity) compared to bitumen higher in the net pay zone. Because of the deposition environment, there are also significant lateral variations of bitumen quality (Adams, J. et al, "Controls on the Variability of Fluid Properties of Heavy Oils and Bitumen in Foreland Basin: A Case History from The Albertan Oil Sands," Bitumen Conf., Banff, Alberta, Sep. 30, 2007).

Figure 6:
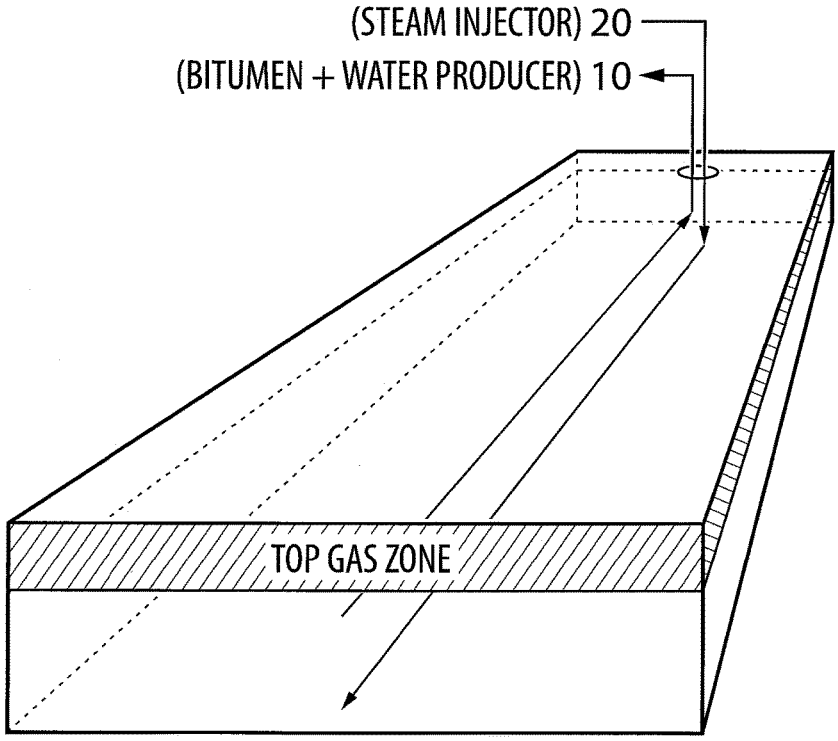
FIG. 6 depicts SAGD in a Top Gas Scenario

The operation of SAGD in a homogeneous bitumen reservoir is straightforward. But, impaired bitumen reservoirs may cause problems for SAGD performance and SAGD operation, as follows:

(1) Top Gas (FIG. 6)—There is a large bitumen resource in Alberta, with top gas that is connected with the bitumen. This poses multiple problems. How does one recover the bitumen without interference from the gas? How does one maximize recovery of bitumen? Does one allow the gas to be recovered first (depleting pressure in the gas zone) or does one recover the bitumen (i.e. which has priority)? Alberta regulators (ERCB) recognized the issues, decided that bitumen has priority and shut in several gas wells in the province (Lowey, M., "Bitumen Strategy Needs Better Grounding, Business Edge, Jan. 15, 2004).

(i) Top gas may act as a thief zone for steam (FIG. 7), so operating pressure of SAGD has to be balanced with gas pressures. But, the balance is delicate.

(ii) If SAGD pressures are too low, top gas may flood the SAGD steam chamber and lower T by diluting steam. This reduces SAGD productivity.

(iii) As shown at the bottom of FIG. 7, if SAGD pressures are too high, steam is lost to the gas zone and SOR will increase.

(iv) Any inhomogenities in the geology or the process may cause (ii) and (iii) to occur simultaneously and accelerate production losses.

(v) If gas migrates to SAGD steam chambers, future gas production may be impaired (vi) If the top gas is already pressure-depleted from prior gas production, the SAGD operator will have to reduce pressure to balance the process and will lose productivity.

Figure 8:
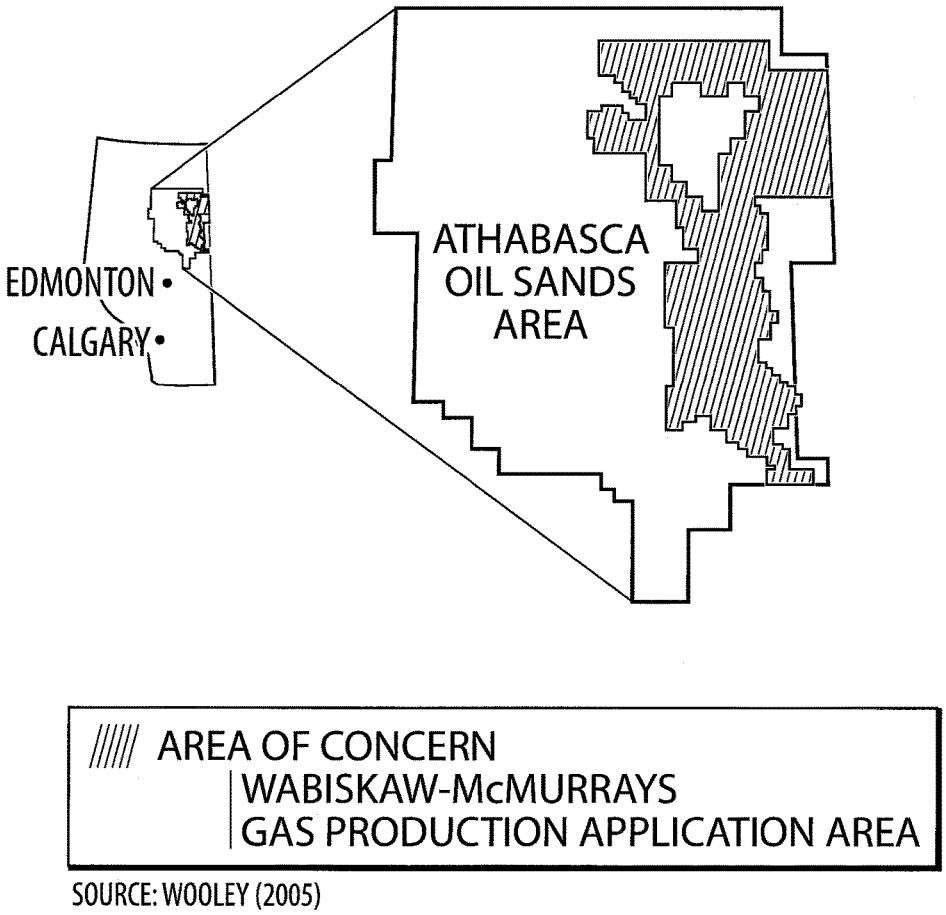
FIG. 8 depicts Gas over bitumen in Alberta

Prior art literature reports the following issues for SAGD with gas-over-bitumen:

(i) The top gas issue was evaluated and 938 gas wells in the concerned area (FIG. 8) were shut-in (Lowey (2004)) (Ross, E. "Injected Air Replaces Gas in Depleted Gas over Bitumen Reservoir" New Tech. Mag., May 1, 2009). At the time, this amounted to about 2% of Alberta's gas production or about 130 MMSCFD of natural gas.

Figure 9:
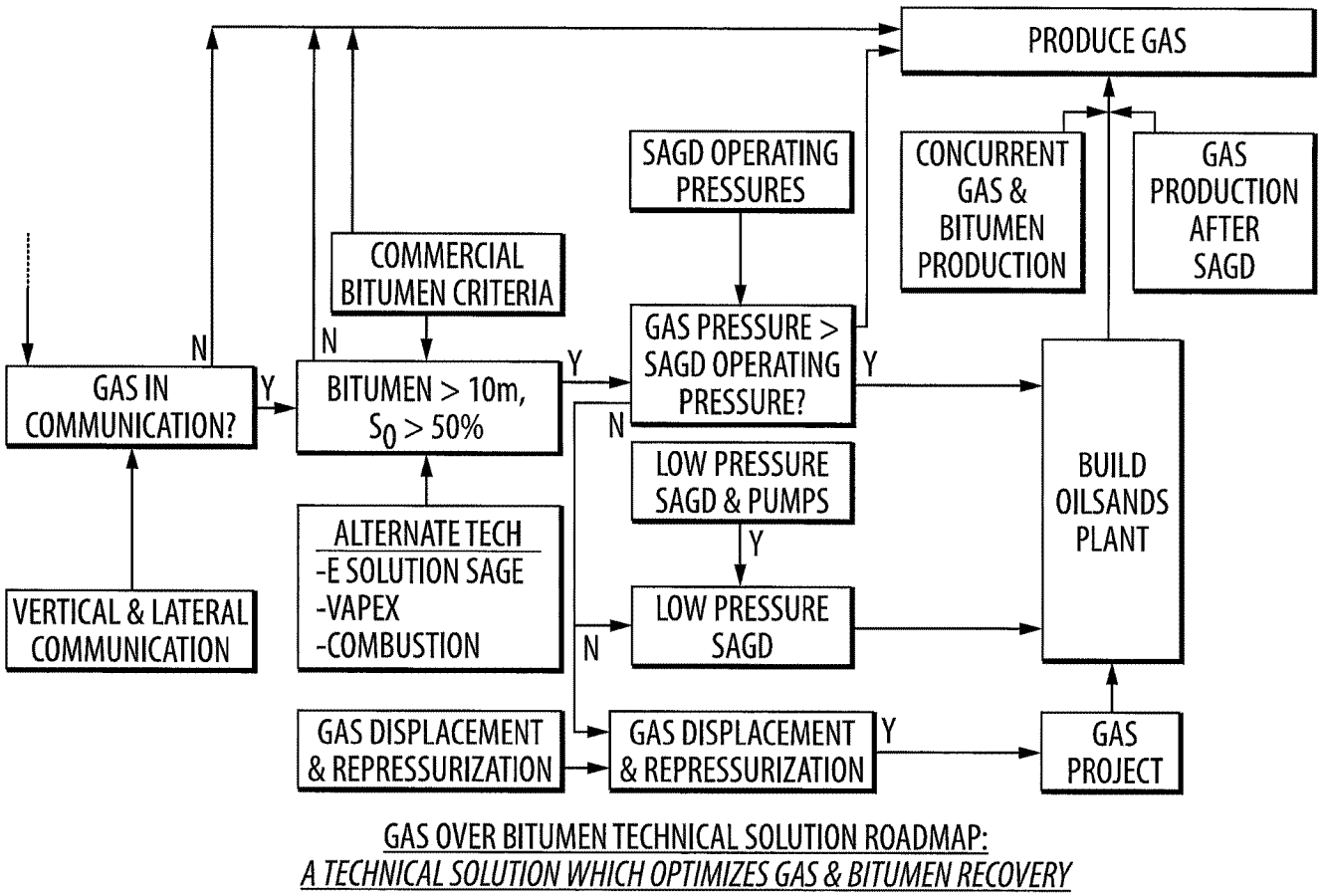
FIG. 9 depicts Gas Over Bitumen Technical Solution Roadmap

(ii) There is a technology roadmap and an industry/government R & D program to try to solve or ameliorate gas-over-bitumen issues (FIGS. 8 and 9) (Alberta, "Gas Over Bitumen", Alt. Energy Website, 2011). The focus is on low pressure SAGD, alternate EOR processes, and gas repressurization schemes. There is some progress, but the issues are not all resolved (Triangle Three Engineering "Technical Audit Report, Gas Over Bitumen Technical Solutions", December 2010) (Jaremko, D., "Pressure Communication", Oilweek, February, 2006).

(iii) A presentation identifies gas-over-bitumen as one of the major issues that needs work and improvement (Industry Canada, "Oil Sands Technology Roadmap—In situ Bitumen Production," August 2010).

(iv) Encana (now Cenovus) has developed a process to combust residual bitumen in the gas zone, near a bitumen reservoir, to repressure the gas zone so that SAGD may be operated at higher pressures to achieve higher bitumen productivity.

(v) A gas-over-bitumen simulation study of CSS in the Clearwater formation concluded that top-gas production has no adverse impact on CSS using horizontal wells (Adegbesan, K. O., "Gas over Bitumen Simulation Study," Kade Tech., Sep. 5, 2006).

(vi) A study investigated the optimum operating pressure for SAGD (Edmunds, N. "Economic Optimum Operating Pressure for SAGD Projects in Alberta," JCPT, December 2001). Based on minimum SOR ratios, the study concluded that low-pressure SAGD was the optimum, in the range of 300 to 900 kPa. The conclusions were largely based on saturated steam properties (FIG. 3), where the latent heat content of steam is maximized at low pressures. The study did not consider that sensible heat (FIG. 3) could partially be captured and utilized by heat recovery from produced fluids. In fact, if this is taken into account, the rule-of-thumb assumption of steam heat as 1000 BTU/lb can be valid for a wide range of pressures where SAGD normally operates (FIG. 3), despite the reduction in latent heat as pressure increases. The study also did not recognize that bitumen productivity (not SOR) is the dominant economic driver for SAGD.

Figure 10:
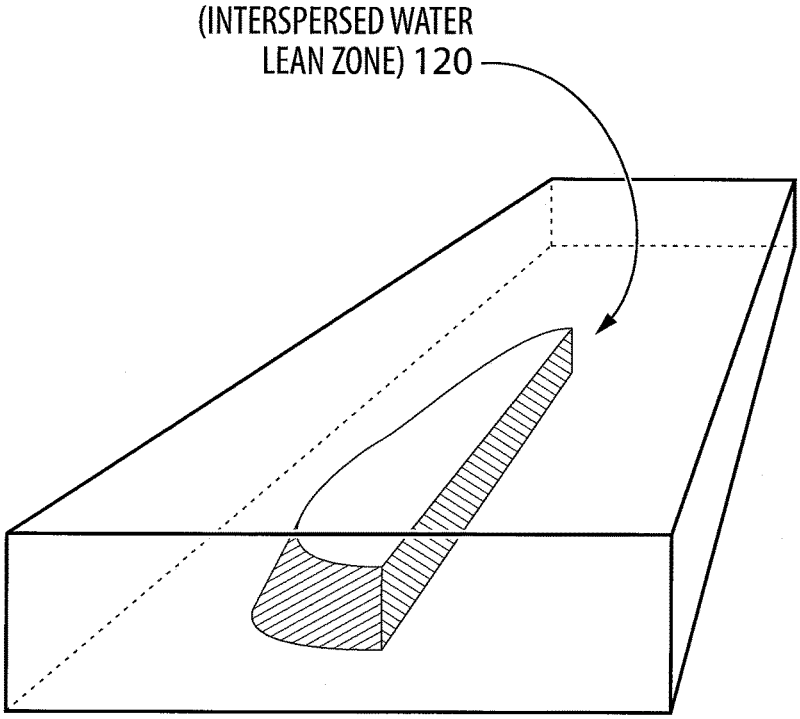
FIG. 10 depicts Interspersed Bitumen Lean Zones

(2) Lean Zones (WLZ)—SAGD has the following problems/issues with interspersed WLZ (FIG. 10):

(i) Interspersed WLZ (120) have to be heated so that GD steam chambers can envelope the zone and continue growth of the GD chamber above and around the WLZ blockage.

(ii) A WLZ has a higher heat capacity than a bitumen pay zone. Table 3 shows a 25% Cp increase for a WLZ compared to a pay zone.

(iii) A WLZ also has higher heat conductivity than a bitumen pay zone. For the example in Table 2, WLZ has more than double the heat conductivity of the bitumen pay zone.

(iv) So, even if the lean zone is not recharged by an aquifier or bottom/top water, the WLZ will incur a thermal penalty as the steam chamber moves through it. Also, since the WLZ has little bitumen, bitumen productivity will also suffer as the steam zone moves through a WLZ.

(v) SAGD steam can heat WLZ water to/near saturated steam T, but it cannot vaporize WLZ water. Breaching of the zone, will require water to drain as a liquid. Initial heating is by conduction, not by steam flow.

(vi) If the interspersed WLZ acts as a thief zone, the problems are most severe. The WLZ may channel steam away from the SAGD steam chamber. If the steam condenses prior to removal, the water is lost but the heat may be retained. But if the steam exits the GD steam chamber prior to condensing, both the heat and the water are lost to the process.

(vii) One remedy is to reduce SAGD pressures to minimize the outflow of steam or water. But, if this is done, bitumen productivity will be reduced.

(viii) If pressures are reduced too far or if local pressures are too low, cold water from a WLZ thief zone may flow into the steam GD chamber or toward the SAGD production well. If this occurs, water production may exceed steam injection. More importantly, steam trap control (sub-cool control) is lost as a method to control SAGD.

(ix) Interspersed WLZ's may distort SAGD steam chamber shapes, particularly if the WLZ is limited in lateral size. Normal growth rates are slowed down as the WLZ is breached. By itself, this may reduce productivity, increase SOR and limit recoveries.

Industry and prior art literature have reported the following WLZ issues:

(ii) Suncor's Firebag SAGD project and Nexen's Long Lake project each have reported interspersed WLZ that can behave as thief zones when SAGD pressures are too high, forcing the operators to choose SAGD pressures that are lower than desirable (Triangle (2010)).

(iii) Water encroachment from bottom water for SAGD can also cause more well workovers (i.e. downtime) because of unbalanced steam and lift issues (Jorshari, K., "Technology Summary", JCPT, March, 2011).

Simulation studies of a particular reservoir concluded that 3 m standoff (3 m from the SAGD producer to the bitumen/water interface) was sufficient to optimize production with bottom water, allowing a 1 m control for drilling accuracy (Akram, F., "Reservoir Simulation Optimizes SAGD", AOGR, September 2010). Allowing for coring/seismic control, the stand off may be higher.

(iv) Nexen and OPTI have reported that interspersed WLZ seriously impedes SAGD bitumen productivity and increases SOR beyond original expectations at Long Lake, Alberta (Vanderklippe, N., "Long Lake Project hits Sticky Patch", CTV news, 2011), (Bouchard, J. et al., "Scratching Below the Surface Issues at Long Lake—Part 2), (Raymond James, Feb. 11, 2011), (Nexen (2011)), (Haggett, J. et al., "Update 3—Long Lake oil sands output may lag targets, Reuters', Feb. 10, 2011).

(v) Long Lake lean zones have been reported to make up from less than 3% to 5% (v/v) of the reservoir (Vanderklippe (2011)), (Nexen (2011)).

(vi) A presentation reported a bitumen reservoir with top lean zones that are "thin to moderate". Some areas had "continuous top thick lean zones" (Oilsands Quest, "Management Presentation," January 2011).

(vii) An article reported Connacher's oil sand project with a top bitumen water lean zone. The lean zone was reported to differ from an aquifier in two ways—"the lean zone is not charged and is limited size" (Johnson, M. D. et al, "Production Optimization at Connacher's Pod One (Great Divide) Oilsands Project, 2011).

(viii) An article reported on Shell's Peace River Project, including a "basal lean bitumen zone". The statistical analysis of the steam soak process (CSS) showed performance correlated with the geology of the lean zone (i.e. the lean zone quality was the important factor). The process chosen took advantage of WLZ properties, particularly the good steam injectivity in WLZ's (Thimm, H. F. et al, "Shale Barrier Effects on SAGD Performance, October 2009).

Figure 11:
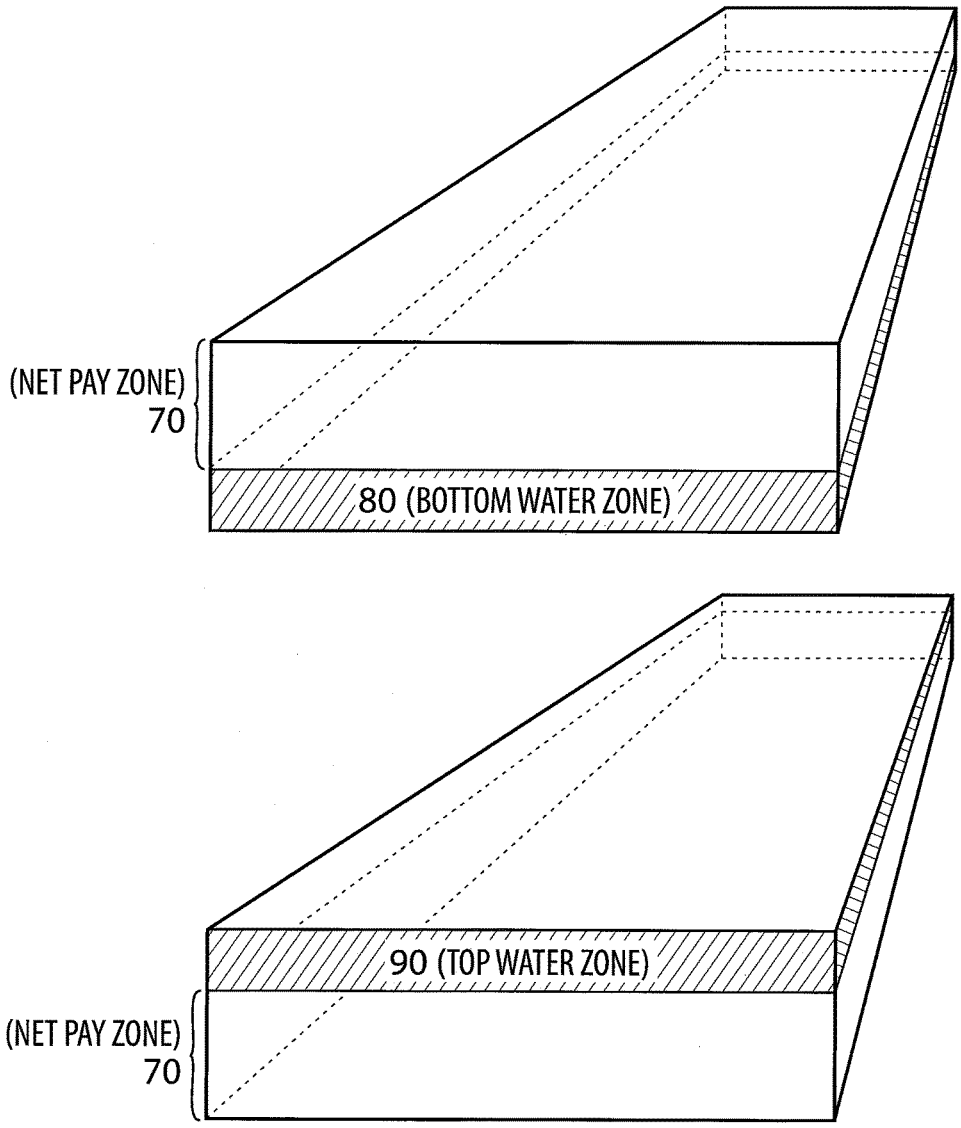
FIG. 11 depicts Top/Bottom Water: Oilsands

(3) Bottom Water (FIG. 11)—The issues are similar to interspersed WLZ except that bottom water (80) underlies the bitumen net-pay zone (70), and the expectation is that bottom water (80) is more active (higher recharge rates) than WLZ. SAGD may operate at pressures greater than reservoir pressure as long as the following occurs: 1) as pressure drops in the production well (due to flow/pumping) don't reduce local pressures below reservoir P and 2) the bottom of the reservoir, underneath the production well, is "sealed" by high-viscosity immobile bitumen (basement bitumen). As the process matures, bitumen proximate the floor will become heated by conduction from the production well. After a few years, this bitumen will become partially mobile, and SAGD pressure will need to be reduced to match reservoir pressure. This may be a delicate balance. SAGD pressures can't be too high or a channel may form (reverse cone) allowing communication with the bottom water. But, steam pressures can't be too low or water will be drawn from the bottom water (cresting). The higher the pressure drops in the production well, the more delicate the balance and the more difficult it is to achieve a balance. If this occurs, water production will exceed steam injection. If the reservoir is inhomogeneous or if the heating pattern is inhomogeneous, the channel or crests can be partial and the onset of the problem is accelerated.

(4) Top Water (FIG. 11)—Again, the issues are similar to interspersed WLZ and bottom water, with the expectation that top water (90) is more active than WLZ (i.e. higher recharge rates). The problems are similar to bottom water (80), as above, except that the SAGD wells are further away from top water. So the initial period, when the process may be operated at higher pressures than reservoir pressure, may be extended compared to bottom water. The pressure drop in the production well is less of a concern because it is far away from the ceiling. The first problem is likely to be steam breaching the top water interface. If the top water is active, water will flood the chamber and shut the SAGD process down, without recourse to remedy.

(5) Shale and Mudstone—If the shale and mudstone deposits are inside the bitumen net pay zone, SAGD can be impaired in one of two ways. If the deposit has a limited areal extent (less than the area of a single SAGD pattern ($\leq$100,000 $m^2$)), the deposit will act as a baffle and slow SAGD down (reduce bitumen productivity, increased SOR) but not substantially affect reserves. If the deposit has an extended areal extent (>100,000 $m^2$), the deposit can act as a barrier and permanently block steam, significantly reducing reserves as well as impairing bitumen productivity and SOR for SAGD.

In order for SAGD to overcome shale baffles or barriers, it must breach the shale (create multi-channel fractures), but SAGD, in some ways, is a delicate process. Even if shale is breached, the vertical permeability in a GD steam chamber is so high (>2D) that a breached-shale (or mudstone) still poses a significant barrier, and so, it will act as a baffle or barrier depending on its areal extent.

Mudstone may have a higher water content than shale. SAGD may induce thermal stress and pore pressures inside the mudstone layer to cause breaching as a result of shear or tensile failure (Li (2007)). But SAGD cannot vaporize the mudstone water.

A review of the literature, involving SAGD and shale/mudstone barriers, includes the following:

(i) An article relates that SAGD is "insensitive to shale streaks and horizontal barriers because steam heating will cause differential heating and create vertical fractures that can serve as steam conduits. Also, as high temperature hits the shale, the shale will be dehydrated and shrink the shale barriers, opening up the vertical fractures (Dusseault, M. B. "Comparing Venezuelan and Canadian Heavy Oil and Tar Sands" CIM, June 2011).

(ii) Personal communication with a geologist in 2011 states that if an in situ combustion front was proximate to a shale, the shale should oxidize and likely fracture. If the organic content was high enough the shale could burn at the interface and potentially create more fracturing. In the presence of steam, combustion could cause "extensive chemical reactions" leading to more fracturing, particularly for carbonate-rich shale.

(iii) Most authors describe shale as an impermeable barrier for SAGD (e.g. Jorshari (2011)).

(iv) Solvent co-injection with steam has been touted as one potential to improve the damage due to shale barrier impairment (Ashrafi (2011)). Solvent reduces T and reduces heat losses, in addition to adding a new direct recovery mechanism (Li, W. et al., "Numerical Investigation of Potential Injection Strategies to Reduce Shale Barrier Impacts on SAGD Process", JCPT, March, 2011).

(v) Geometry may also mitigate shale barrier effects but impacts are moot. A study shows that placement of the injector well diagonally through the shale barrier improved performance (Ashrafi, M. et al "Numerical Simulation Study of SAGD Experiment and Investigating Possibility of Solvent Co-injection" July 2011). Another study shows that an additional injector above the shale barrier has only a marginal improvement (Li, P. et al, "Gasover Bitumen Geometry and its SAGD Performance Analysis with Coupled Reservoir Gas Mechanical Simulation, January 2007).

(vi) It has also been asserted that hydraulic (vertical) fractures and/or mobility control foams may improve SAGD in reservoirs with shale barriers (Chen, Q. "Assessing and Improving SAGD: Reservoir Homogeneities, Hydraulic Fractures and Mobility Control Foams" Stanford PhD Thesis, 2009), (Chen, Q. et al, "Effects of Reservoir Homogeneities on SAGD" October 2008). A study suggests dilation induced by pressure cycling as a possible remedy. Limited shale slows down bitumen production. Continuous shale changes the geometry of the SAGD steam chamber and reduces the thermal efficiency (Ipek, G. et al "Numerical Studies of Shale Issues in SAGD" Can. Intl. Pet. Conf. Calgary Jun. 17, 2008).

(vii) Shale size effects have been looked at using a simulation model. If the shale is limited in areal size and directly above the producer (under the injector) the main effect is a start-up delay for shale barriers 3 to 5 m in extent. For 10 m or greater, the impact is more severe. If the shale is above the injector, barriers of 5 to 25 m are not critical, barriers greater than 50 m are more severe (Shin, H. et al, "Shale Barrier Effects on SAGD Performance" SPE, Oct. 19, 2009). Another study also conducted a similar experiment and concluded that for shale barriers above the steam injector, only barriers larger than 50 m had a significant effect on SAGD performance (Dang, C. T. Q, et al "Investigation of SAGD in Complex Reservoirs" SPE, October 2010).

Figure 13:
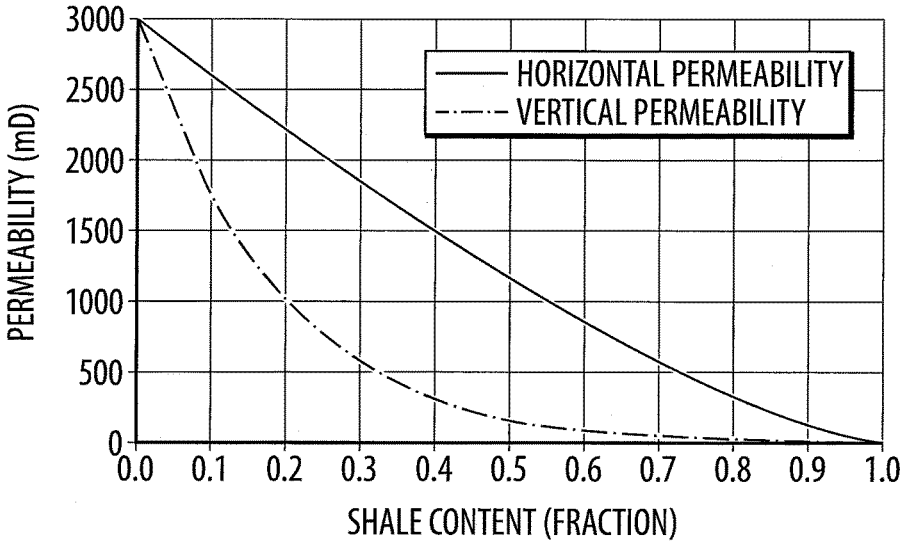
FIG. 13 depicts The Effect of Discontinuous Shales on Reservoir Permeability

(viii) A study conducted a simulation of SAGD in a reservoir with top gas, considering shale that affects SAGD performance. The model includes 2 effects—heat demanded if/when shale is saturated in water and flow barriers caused by the shale. Shale permeability measurements were in the range $10^{-6}$ to $10^{-3}$ mD (very low). Assuming laterally discontinuous shale, the bulk permeability used in the model to predict SAGD performance is shown in FIG. 13, as a function of reservoir shale content in the reservoir. The dominant effect of discontinuous shale is to strongly decrease vertical permeability—a key factor for SAGD performance (Pooladi-Darvish, M. et al, "SAGD Operations in the Presence of Overlying Gas Cap and Water Layer-Effect of Shale Layers", JCPT, June, 2002).

(ix) Another text predicts that SAGD productivity is proportional to the square root of vertical permeability (Butler 1991). This has been verified in scaled physical model tests of the process. So, using FIG. 13, the effect of discontinuous shale on SAGD bitumen productivity may be calculated. For 20% shale content, the reduction is 42%. For 30% shale content, the reduction is 59% and, for 40% shale content, the reduction is 71%.

(x) It has been estimated that the average shale content in the McMurray formation containing bitumen is about 20% to 40%. Discontinuous shale is a major barrier to fully exploiting the bitumen resource.

There is some disagreement as to the extent of shale barriers being impediments for SAGD, but there is no disagreement as to shale impeding SAGD. SAGD is sensitive to shale heterogeneities in the bitumen pay zone. SAGDOX offers an opportunity to reduce/remove these sensitivities.

(6) Thin Pay—It is generally accepted that the economic limit for SAGD is about 15 m of net bitumen pay. Below this limit, the resource is too sparse for SAGD to be economic—heat losses cause SOR to be too high and low gravity head limits bitumen productivity. Bitumen productivity is usually a key economic driver. The key cost factor is the cost of steam. It has been shown that bitumen productivity is proportional to the square root of the net pay thickness (Butler 1991). If an alternate GD process can significantly reduce the cost of energy, the process could economically be applied to much thinner pays than the limit for SAGD. For example, if the limiting factors are bitumen productivity and energy costs, a 20% cut in energy costs would reduce the net pay constraint from 15 m to about 10 m. This could broaden the applicability of an EOR process and increase the ultimate recoverable bitumen from the resource base.

(7) Bitumen Quality Gradients—Significant bitumen quality (i.e. viscosity) gradients in most bitumen reservoirs are expected (Adams (2007)). There are 2 concerns—vertical and lateral. The lowest API (highest density) bitumen and the highest viscosity bitumen are at the bottom, where SAGD is normally started. Bitumen viscosity can increase by a factor of 100 with depth for a 40 m thick reservoir. The impairment to SAGD will be a delay in start-up and lower productivity in the beginning Lateral variations can increase lateral pressure drops and harm conformance control.

The situation can be improved if an alternate process can start up higher in the reservoir, where the bitumen is less dense and the early productivity can improve. SAGDOX is a process similar to SAGD, but, it uses oxygen gas as well as steam to provide energy to the reservoir to heat bitumen. The GD chamber is preserved but it contains a mixture of steam and hot combustion gases.

A detailed description of SAGDOX may be found in patent applications US2013/0098603 and WO2013/006950, herein incorporated by reference, as well as U.S. Ser. No. 13/543,012 and 13/628,164 from which we claim priority and herein incorporate by reference.

Figure 14:
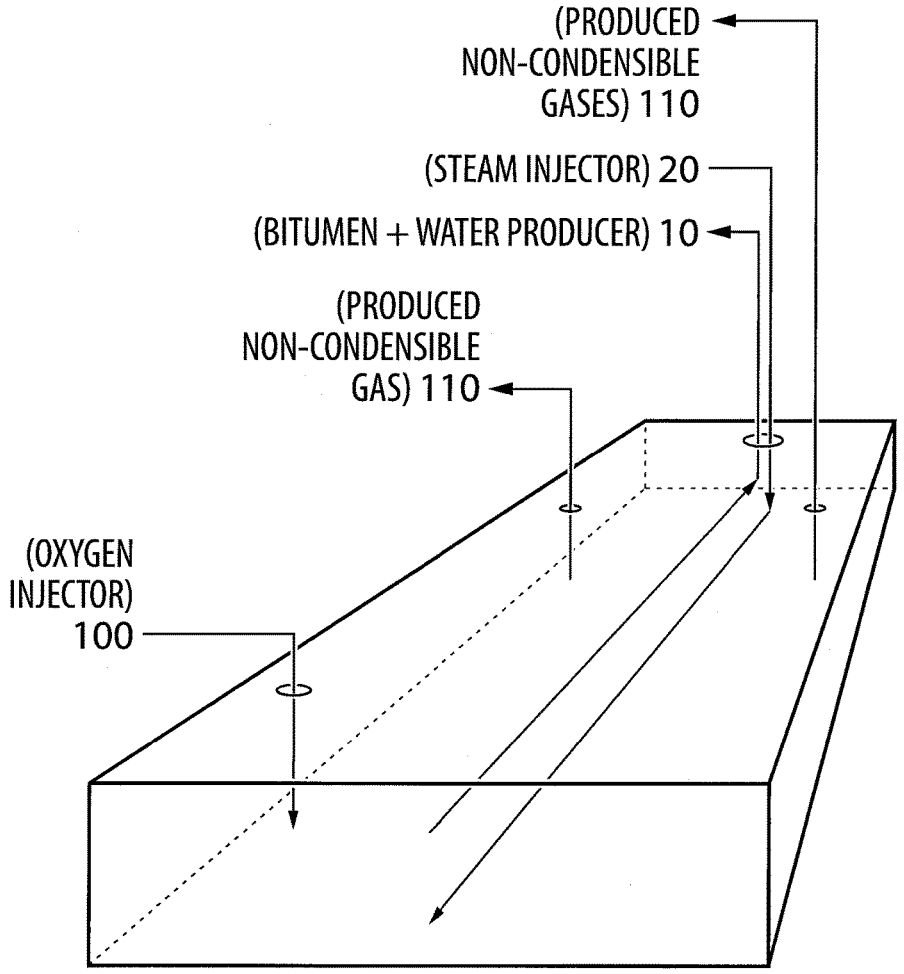
FIG. 14 depicts typical SAGDOX geometry

SAGDOX may be considered a hybrid process, combining steam EOR(SAGD) and in situ combustion (ISC). SAGDOX preserves the SAGD horizontal well pair (10, 20), but the process adds at least 2 new wells (FIG. 14)—one well to inject oxygen gas (100) and a second well (110) to remove non-condensable combustion gases. Compared to SAGD, SAGDOX has the following advantages/features:

1. Steam adds heat directly by condensing; Oxygen adds heat by combusting residual bitumen.
2. Per unit heat delivered to the reservoir, oxygen is significantly less costly than steam.
3. Per unit heat delivered to the reservoir the volume of oxygen needed is about one-tenth the volume of steam (Table 1), so gas volumes of steam and oxygen mixes can be much less than for steam only.
4. Steam-only processes use saturated steam in the reservoir, so T, P conditions are limited by the properties of saturated steam (FIG. 3). If pressure needs to be reduced to approach native reservoir P, temperatures will be reduced automatically. Oxygen mixtures of $O_2$ and steam can remove this constraint. Combustion temperatures are higher than saturated steam P (~600° C. vs. 200° C.) and they are not strongly related to reservoir P.
5. Steam helps combustion—it preheats the reservoir so ignition can be spontaneous, it adds $OH^-$ and $H^+$ radicals to the combustion zone to improve and stabilize combustion. It acts as a good heat transfer medium by condensing at the cold hydrocarbon interface to release latent heat.
6. Oxygen helps steam—combustion produces steam as a chemical product of combustion, connate water is vaporized and water can be refluxed. Most importantly, at the same reservoir P, combustion can operate at a higher average T than steam.
7. The oxygen content in steam and oxygen mixes (e.g. Table 1) is used as a way to label the process. The term mix or mixture doesn't imply that a mixture is injected or that good mixing is a prerequisite for the EOR process. It is only a convenient way to label the process. In fact, the preferred process has separate injectors for oxygen and steam.
8. There is a preferred range of $O_2$ content in steam+oxygen mixtures (from about 5 to 50% (v/v)). Below 5% oxygen, the combustion zone is very small and, if mixed, combustion can start to become unstable. Above 50% oxygen, steam levels in the reservoir can become too low for good heat transfer and produced liquids (water+bitumen) are too rich in bitumen for good flow.

SAGDOX also has the following features that are useful for EOR in impaired bitumen reservoirs:

1. The oxygen injector vertical wells and the produced gas (PG) vent wells are small diameter wells—preferably 3 to 4 inches D for most SAGDOX operations. The wells are inexpensive to drill.
2. Multiple $O_2$ injectors and PG vents do not detract from SAGDOX performance; multiple wells help in conformance control.
3. If multiple oxygen injectors or PG vent wells are needed, the individual well diameters are preferably in the 2 to 3 inch range. Preferably these wells may potentially be drilled using coiled tubing rigs.
4. The oxygen injector may be completed in/near a WLZ (water lean zone) or near a shale barrier to take advantage of residual fuel in the WLZ or hydrocarbon fuel in shale.
5. Especially at lower pressures (<2000 kPa), SAGDOX may have average temperatures much higher than SAGD. Combustion occurs at T between 400° C. and 800° C. (HTO) compared to steam T<250° C.
6. SAGDOX higher T's may aid in vaporization of WLZ water and thermal fracturing of shale.
7. For the same bitumen production rates, SAGDOX has lower fluid flow rates (bitumen+water) in the horizontal production well. This will lower pressure drops down the length of the well, producing a more-even pressure distribution than SAGD.
8. Energy costs for steam+oxygen mixes are less costly than steam, so a SAGDOX recovery process may be operated longer to increase reserves and thinner pays may be developed when compared to SAGD.

SAGDOX in a top gas impaired bitumen reservoir has several advantages compared to SAGD—namely:

i. SAGDOX may operate at lower P than SAGD and still maintain high temperatures in the GD chamber, resulting in higher bitumen productivity. This allows the operator to match SAGDOX and top gas pressures, to minimize leakage to the top gas thief zone, while maintaining bitumen productivity.

ii. SAGDOX produces non-condensable gas, mostly $CO_2$, as a product of combustion. The SAGDOX process can be controlled using a PG vent well (FIG. 14 items 3 and 4) or multiple vent wells (110) (FIG. 15 in a reservoir with a top gas zone (60)). It has been shown in the literature that non-condensable gas with steam (Jiang (1998)) in a SAGP process collects at the top of the steam zone and has 2 effects compared to SAGD. First, the ceiling of the GD chamber is insulated by the gas and heat losses to the overburden are reduced. Second, the shape of the GD chamber is distorted to favor lateral growth, not vertical growth. For SAGDOX, the non-condensable gas content may be controlled using PG vent wells (110) (FIG. 15), to increase bitumen production (compared to SAGD)—i.e. increased reserves.

iii. SAGDOX costs are significantly less than SAGD, per unit energy delivered to the bitumen reservoir, particularly for SAGDOX processes with high oxygen levels (~50% (v/v) oxygen in steam+oxygen mixes). This is a direct result of the fact that oxygen costs are about ⅓ steam costs, per unit energy delivered. So, top gas reservoirs amendable to SAGD would have fewer costs for SAGDOX. Some top gas reservoirs that are marginal for SAGD, may be economic for SAGDOX.

If the SAGDOX P is too high, SAGDOX may breach the top gas zone with the main contaminant being $CO_2$. Carbon dioxide can be tolerated in methane up to a few percent or it can be removed in a gas treatment plant using well known technology.

Figure 12:
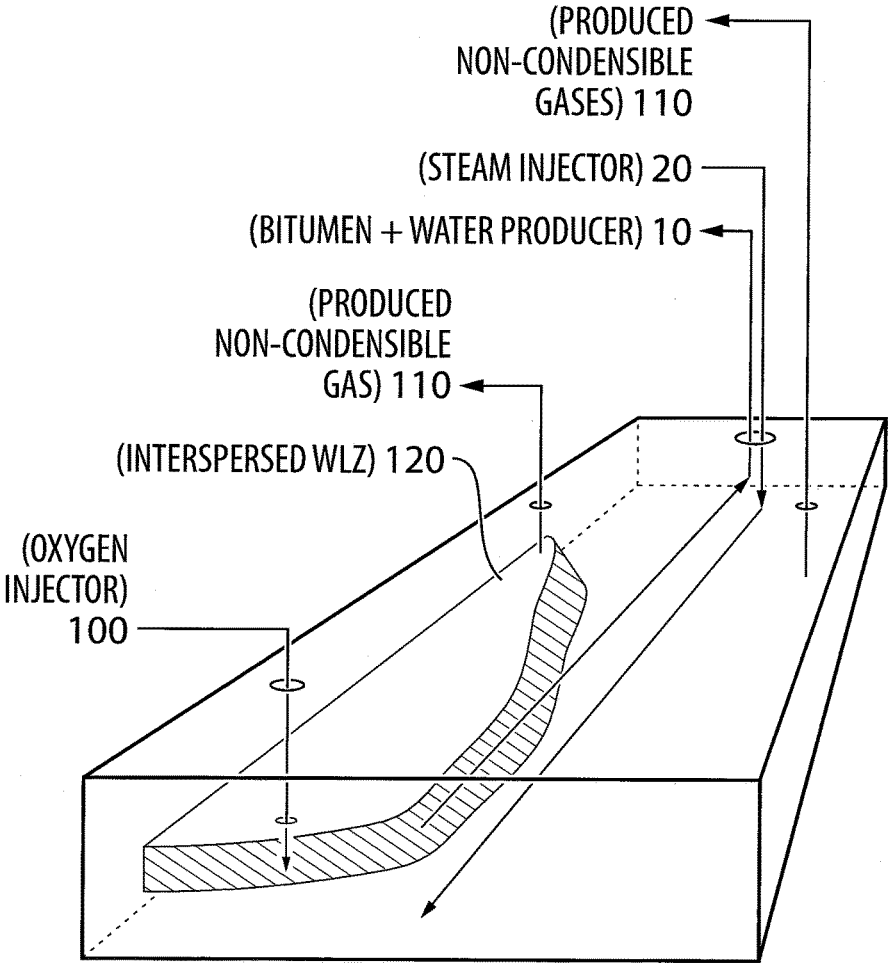
FIG. 12 depicts SAGDOX with Interspersed WLZ

SAGDOX in a WLZ reservoir may use the traditional SAGDOX geometry (FIG. 12), or the oxygen injector well (100) may be completed inside the WLZ (FIG. 16), whether continuous or discontinuous.

Figure 15:
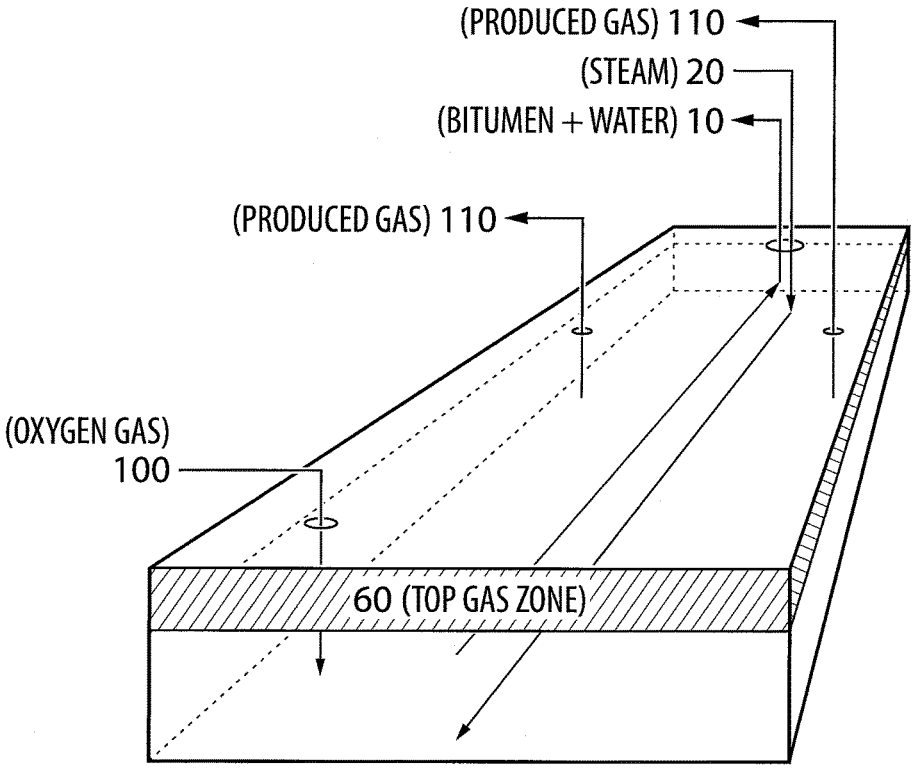
FIG. 15 depicts SAGDOX in a Top Gas scenario according to one embodiment of the present invention

Although a WLZ may pose a problem for SAGD, it may be an opportunity for SAGDOX. As long as the bitumen saturation in the WLZ is above about 5.5% (v/v), there is enough energy via combustion of this bitumen to vaporize all the water in the WLZ. If bitumen saturation is higher than this amount, bitumen from the WLZ will be recovered as incremental production (FIG. 15). This incremental bitumen would not be recovered by the steam SAGD process.

The WLZ may afford an opportunity to complete the oxygen injection well inside the WLZ (FIG. 12), particularly if the WLZ is an interspersed zone in the midst of the pay zone. Since a WLZ has good fluid injectivity, it may act as a natural horizontal well to help disperse oxygen for combustion (this may also work for a top WLZ or a bottom WLZ). If the WLZ is not already preheated by steam to about 200° C., it may be necessary to inject some steam prior to oxygen injection to ensure ignition and HTO reactions.

Figure 17:
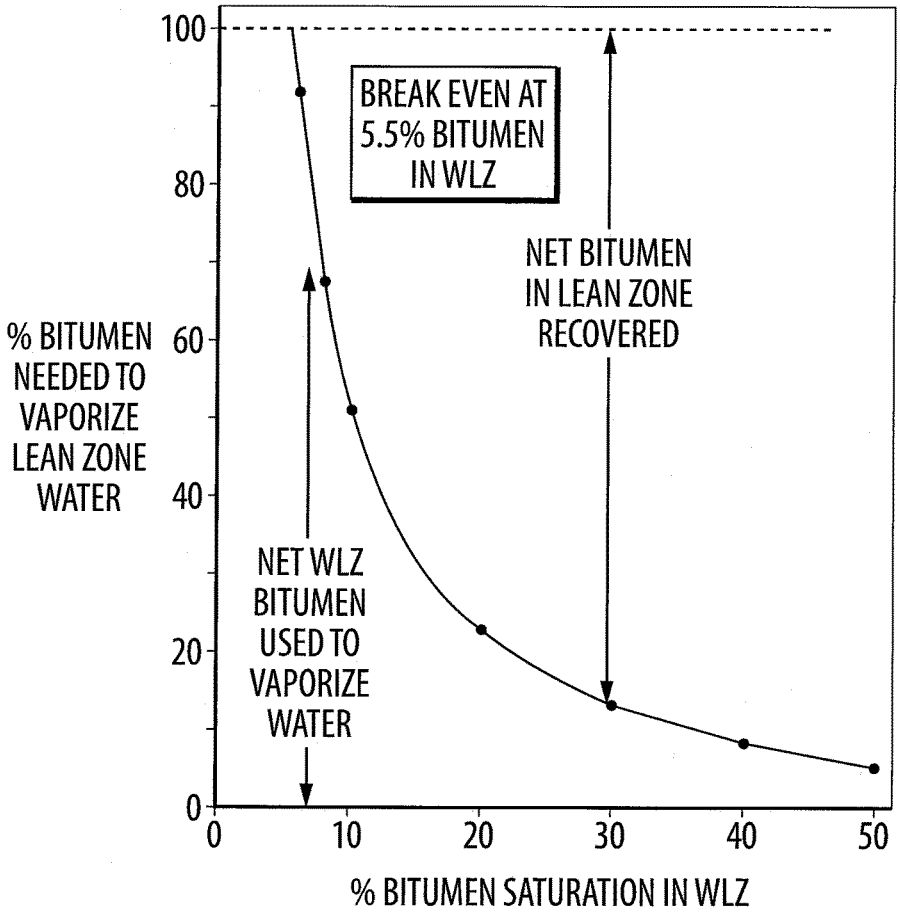
FIG. 17 depicts WLZ bitumen recovery according to one embodiment of the present invention.
Figure 18:
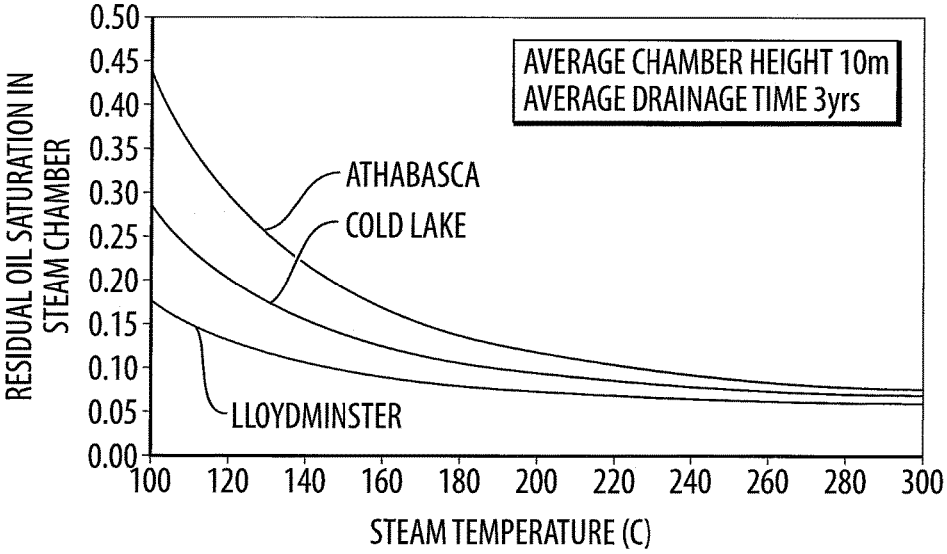
FIG. 18 depicts Residual Bitumen in Steam-Swept Zones

In summary compared to SAGD, the advantages of SAGDOX in a bitumen reservoir with WLZ are as follows:

i. The oxygen injector well may be completed into the WLZ to take advantage of the fuel value of residual bitumen, to recover some of the bitumen and the high injectivity of the WLZ (FIG. 16).

ii. Oxygen may burn residual bitumen in the WLZ and vaporize WLZ water—a faster way to breach a WLZ than saturated steam heating. SAGD cannot vaporize water in the WLZ, the process can only heat water to near saturated steam T and hope the water will quickly drain without being replaced by outside water flow (i.e. thief zone behavior).

iii. For most WLZ's (FIG. 17) oxygen may combust residual bitumen and recover bitumen that would otherwise be left behind. A combustion-swept zone has almost zero residual bitumen; a steam-swept zone can have 10-20% residual unrecovered bitumen (FIG. 18).

iv. Especially at lower pressures, steam and $O_2$ EOR may have average T much higher than saturated steam. Combustion occurs at 400-800° C.; steam EOR operates at 150-250° C. for lower P reservoirs.

i. Increased productivity ii. Increased production/reserves.

iii. Increased efficiency v. The use of residual bitumen or heavy oil as fuel in the WLZ and the recovery of some bitumen will increase recovery (i.e. reserves) of bitumen.

vi. Oxygen is less costly than steam, per unit energy injected, so the SAGDOX economic limit will increase reserves compared to SAGD.

Bottom water poses a particular problem for SAGD Impairment is inevitable if the bottom water is active, driven mostly by pressure gradients in the horizontal production well. But, SAGDOX, for the same bitumen production as SAGD, has lower fluid flows (water and bitumen) in the production horizontal well. This will lower ΔP down the well length, producing a more-even and lower pressure in the process pattern than SAGD. This makes it easier to balance top WLZ, bottom WLZ, or interspersed WLZ.

Top water is more harmful than bottom water, since drainage into the GD chamber is driven by a gravity head of about 50 psia (335 KPa) for 30 m of net pay. The advantages to SAGDOX are similar to the top gas issue, namely:

i. SAGDOX allows pressure balance (low P operation) without losing as much bitumen productivity.

ii. The non-condensable gas produced in SAGDOX (PG) allows insulation of the ceiling and distorting the shape of the GD chamber to favor lateral growth. Both allow increased bitumen production prior to ceiling break through.

iii. Reduced SAGDOX costs can extend economic limits and increase reserves.

In shale and mudstone, the ISC component of SAGDOX adds the enhanced ability to better breach shale barriers (breaching equals creation of multiple, high-permeability, vertical flow paths (fractures) through the shale barrier). SAGDOX is better than SAGD for this, for the following reasons:

i. ISC produces much higher temperatures than saturated steam, typically 400 to 800° C. vs. 200-300° C. for steam. So thermal gradients are larger and shale fracturing should be quicker and more extensive.

ii. Combustion may vaporize water associated with shale and remove it from the shale zone as a vapor. Saturated steam can only heat water up to saturated T, and cannot provide latent energy to vaporize the water.

iii. Combustion T is not strongly influenced by P. At low P, SAGD T can be 200° C. or lower.

iv. Any organic component of the shale may be oxidized to accelerate the breaching process. If the organic component is high enough (>2% (w/w)), the shale can sustain in situ combustion.

v. If the oxygen injector is close to the shale, preferably just beneath the shale layer, shale breaching may be accomplished at the early stages of the SAGDOX process. Also, the local oxygen levels may be high and the hot combustion gases undiluted by steam. This may speed up dewatering or dehydrating of the shale to accelerate breaching of the shale zone.

Figure 19:
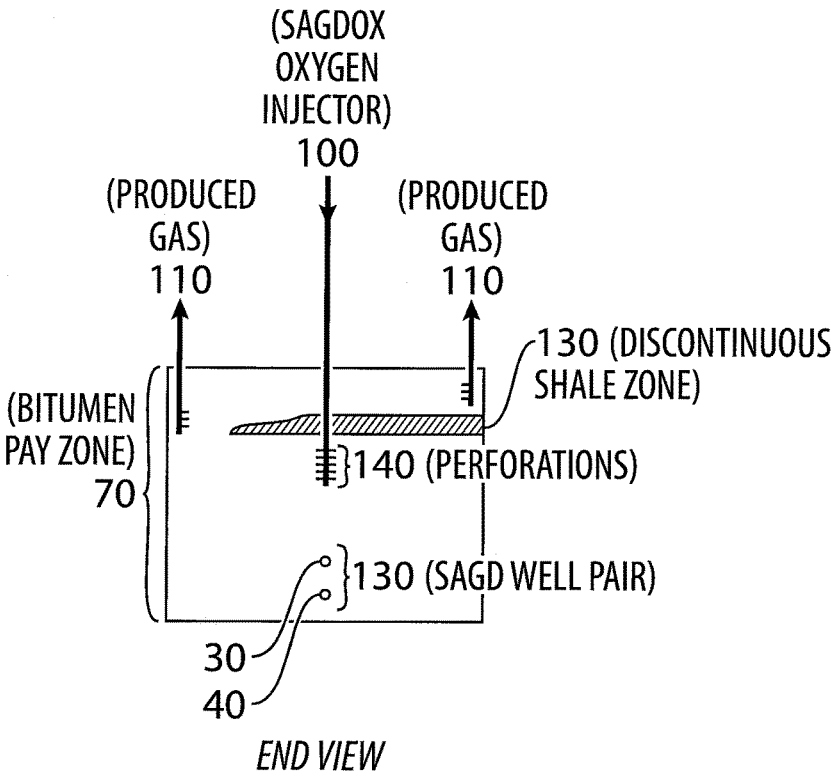
FIG. 19 depicts Placement of SAGDOX, $O_2$ Injector in a Shaley Reservoir (Discontinuous Shales)

Referring now to FIG. 19, the first case to consider is a discontinuous shale barrier (130). Even if the barrier (130) is limited and off-center in the SAGDOX pattern (130), the oxygen injector (100) may be relocated to just underneath and near the center of the shale barrier (130), without significantly impairing SAGDOX performance. If the off-center location causes an imbalance of the flow pattern (reduced conformance), compensation may be attained by adjusting the vent rates in the PG vent wells (110). Perforation (140) (injection) location for oxygen is best just beneath the shale barrier (130). Combustion tends to rise, so we can be assured of good contact with the shale barrier.

Figure 20:
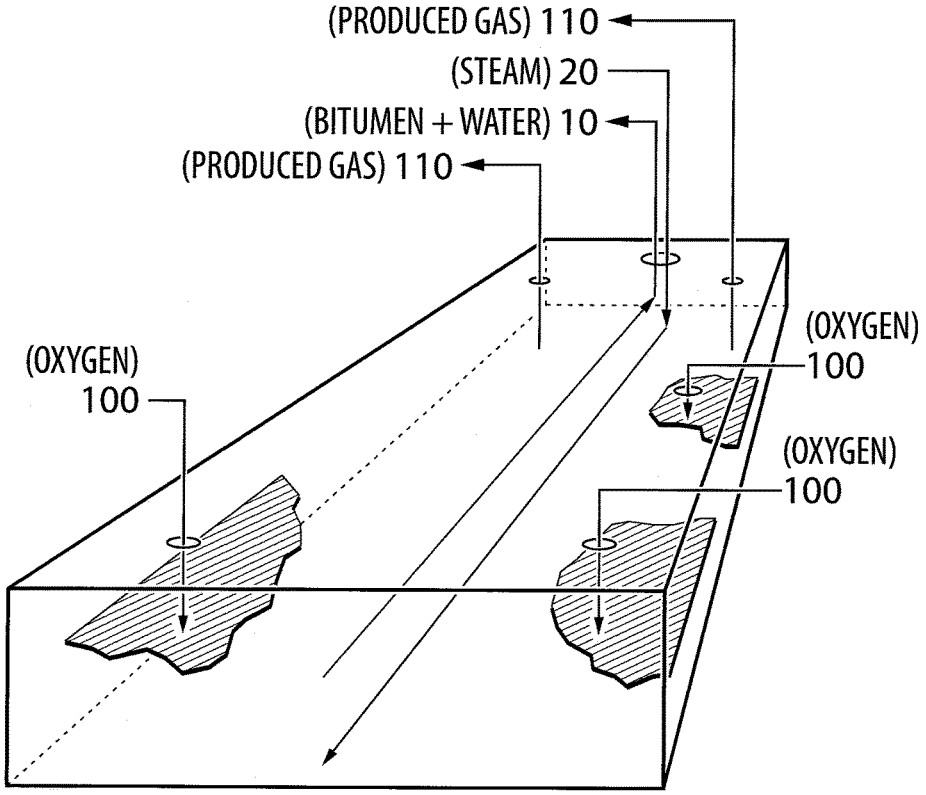
FIG. 20 depicts SAGDOX: Multiple Limited Shale Barriers

If discontinuous shale with multiple barriers are present within a SAGDOX production pattern, $O_2$ may be injected using multiple wells (100), each targeted to breach a shale barrier (130) (FIG. 20). With discontinuous shale barriers and some communication with vent wells, the PG vent wells need not be moved (FIG. 20).

Figure 21:
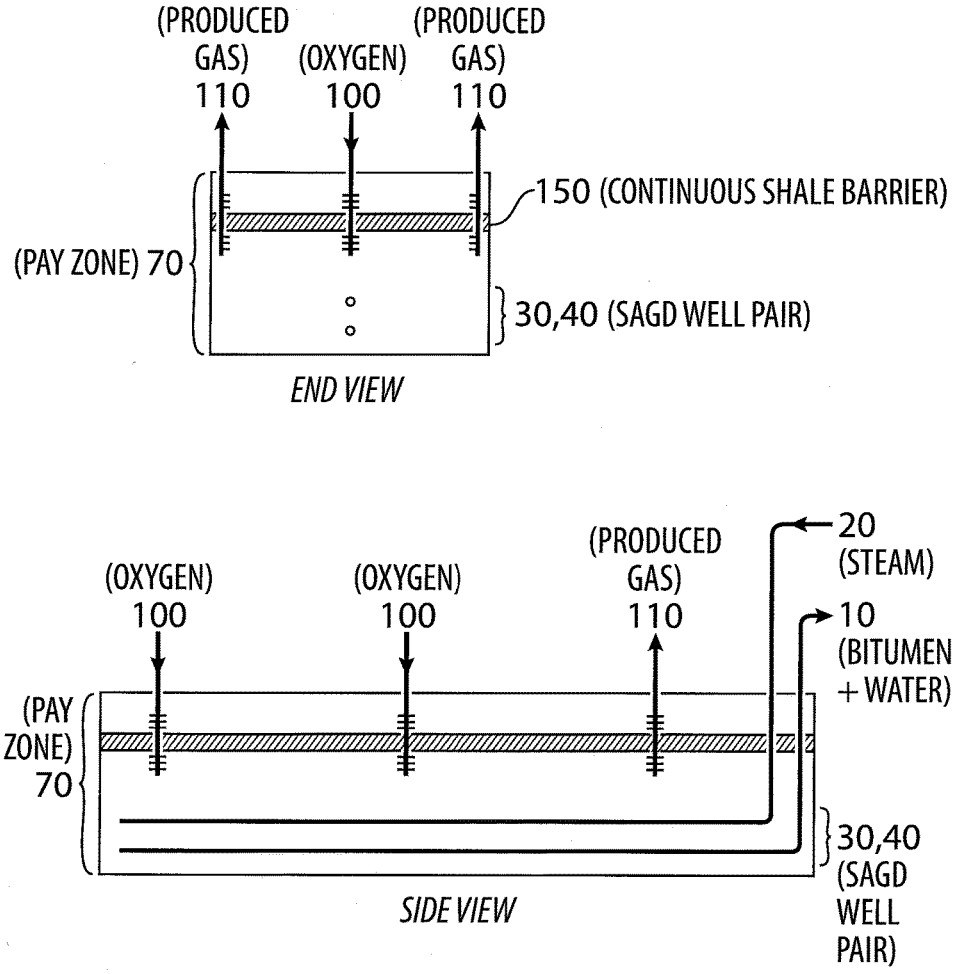
FIG. 21 depicts Placement of SAGDOX, $O_2$ Injector and PG Vent Wells for a Continuous Shale Barrier

The second case to consider is a continuous shale barrier across the SAGDOX production pattern as best seen in FIG. 21. Multiple $O_2$ injectors (100) are preferred to create an extensive breach area in the shale. FIG. 21 shows an illustrative solution using two $O_2$ injector wells (100). Each $O_2$ injector well (100) has a dual completion, above and below the shale barrier, with an internal packer to direct $O_2$ flow to one or both of the perforated zones. Alternately, if no packer is used, oxygen will initially be directed, naturally, to the lower zone, with some established injectivity due to steaming. At a later time, after the shale barrier is breached, steam and hot combustion gases will create injectivity in the upper zone. Another option is to only complete the $O_2$ injector in the lower zone, just below the shale. Then, as the shale breach is mature, recomplete the injector in the upper zone. Recompletion in the upper zone may not be necessary if the shale breach is large.

Each PG vent well has similar options. This may also be extended to multiple continuous shale barriers.

SAGDOX has more tolerance than SAGD for thin pay reservoirs. The operating cost for SAGDOX is much lower than SAGD because the cost of oxygen gas, per unit energy delivered to a bitumen reservoir is about a third the cost of steam. So if a SAGDOX process with 50/50 (v/v) mixture of steam and oxygen is chosen, about 91% of the energy to the reservoir comes from oxygen and 9% comes from steam (Table 1). This process is labeled as SAGDOX (50). The relative cost of energy for SAGDOX (50) compared to SAGD is 0.39 to 1.0. So the economic limit for SAGDOX (50) for a thin net pay reservoir can be extended well beyond the limit for SAGD.

Bitumen Quality (i.e. viscosity) Gradients impair SAGD mainly because poorest quality bitumen is at the bottom of the net pay where SAGD is started. SAGDOX is started at/near the bottom, similar to SAGD, but also near the middle of the pay zone, where oxygen is first injected. Thus, on average, SAGDOX will produce higher quality bitumen and have a higher productivity than SAGD in the earlier stages of recovery.

Lateral pressure drops for SAGDOX are less than SAGD because, for the same bitumen production, fluid flow rates in the production well are less due to reduced water injected and produced. So any lateral bitumen quality variation will have less impact on lateral conformance for SAGDOX compared to SAGD.

Some of the preferred conditions of the present invention are listed as follows:

(1) Use oxygen injector completion location as a way to mitigate bitumen production impairment from IBR's.

(2) Adjust SAGDOX P to close/near native reservoir P to mitigate IBR damages on bitumen productivity.

(3) Increase reserves c/w SAGD by using SAGDOX and (1) & (2) above.

(4) Use multiple $O_2$ wells, if necessary to mitigate bitumen production impairment from IBR's.

(5) Compare SAGDOX to SAGD in IBR's. (SAGD is the dominant bitumen EOR process and the basis for the assessed recoverable resource estimate).

(6) bitumen is defined as <10 API, >100,000 cp.

(7) Increase $O_2$ levels to high-end of SAGDOX range of $O_2$/steam ratio between 0.5 and 1.0 (v/v).

(8) Use residual fuel in WLZ.

(9) SAGDOX for Thin Pays.

Several features that form part of the present invention over SAGD in IBRs are as follows:

(1) Use SAGDOX EOR in IBRs.

(2) Bitumen reservoirs are the preferred target.

(3) Use $O_2$ injector in order to mitigate performance damage from impairments in bitumen reservoirs.

(4) Use multiple $O_2$ wells for multiple impairments in bitumen reservoirs.

(5) Use PG vent wells to improve conformance for non-symmetrical $O_2$ injector wells/patterns.

(6) Take advantage of fuel value of WLZ.

(7) Higher T than SAGD.

(8) Lower energy cost than SAGD.

Other embodiments of the invention will be apparent to a person of ordinary skill in the art and may be employed by a person of ordinary skill in the art without departing from the spirit of the invention.

TABLE 1

| Steam + Oxygen Mixtures % (v/v) Oxygen in Mixture | | | | | | | |
|---|---|---|---|---|---|---|---|
| | 0 | 5 | 9 | 35 | 50 | 75 | 100 |
| % Heat from $O_2$ | 0 | 34.8 | 50.0 | 84.5 | 91.0 | 96.8 | 100 |
| BTU/SCF Mix | 47.4 | 69.0 | 86.3 | 198.8 | 263.7 | 371.9 | 480.0 |
| MSCF/MMBTU | 21.1 | 14.5 | 11.6 | 5.0 | 3.8 | 2.7 | 2.1 |
| MSCF $O_2$/MMBTU | 0.0 | 0.7 | 1.0 | 1.8 | 1.9 | 2.0 | 2.1 |
| MSCF Steam/MMBTU | 21.1 | 13.8 | 10.6 | 3.3 | 1.9 | 0.7 | 0.0 |

Where:

(1) Steam heat value=1000 BTU/lb (avg.)

(2) $O_2$ heat value=480 BTU/SCF (Butler (1991))

(3) 0% oxygen=100% pure steam=SAGD

TABLE 2

| Lean Zone Thermal Conductivities | |
|---|---|
| | [W/m° C.] |
| Lean Zone | 2.88 |
| Pay Zone | 1.09 |

Where:

(1) Lean zone=80% water saturation; pay zone=80% oil saturation (2) $\Phi$=0.35

(3) Algorithm as per Butler (1991) for sandstone (quartz) reservoir.

TABLE 3

| Lean Zone Heat Capacities | | | |
|---|---|---|---|
| Heat Capacity | Pay Zone | Lean Zone | % Increase |
| (kJ/kg) | 1.004 | 1.254 | 24.9 |
| (kJ/m$^3$) | 2071.7 | 2584.7 | 24.8 |

Where:

(1) Uses Butler's algorithms for Cp of bitumen, water, sandstone (Butler (1991)).

(2) Assumes API=8.0 sg.=1.0143

(3) Assumes T=25° C.

(4) Pay zone=35% porosity with 80% bitumen saturation (5) Lean zone=35% porosity with 80% water saturation

TABLE 4

| 1000BD Production Pattern % (v/v) $O_2$ in $O_2$ and Steam Mix | | | | | | |
|---|---|---|---|---|---|---|
| | 0 | 5 | 9 | 20 | 35 | 50 |
| Liquids (B/D) | | | | | | |
| Water | 3370 | 2200 | 1690 | 950 | 520 | 300 |
| Bitumen | 1000 | 1000 | 1000 | 1000 | 1000 | 1000 |
| Water + Bitumen | 4370 | 3200 | 2690 | 1950 | 15200 | 1300 |
| % Bit Out | 22.9 | 31.3 | 37.2 | 51.3 | 65.8 | 76.9 |
| % SAGD Flow | 100.0 | 73.2 | 61.6 | 44.6 | 34.8 | 29.7 |
| Gas | | | | | | |
| Oxygen (MMSCFD) | 0 | 0.86 | 1.23 | 1.76 | 2.08 | 2.24 |
| (SCF/bbl bit) | 0 | 856 | 1230 | 1760 | 2080 | 2237 |

Where:

(1) All cases for ETOR=1.18

The invention claimed is:

1. A process to produce bitumen utilizing at least one water lean zone (WLZ) within a bitumen-comprising subterranean reservoir, the process comprising:

installing a steam assisted gravity drainage (SAGD) system within the reservoir, the SAGD system comprising:

a production well having a horizontal distal portion and a vertical proximal portion in communication with an extraction pump; and a steam injection well having a horizontal distal portion above the horizontal distal portion of the production well and a vertical proximal portion in communication with a steam source:

installing an oxygenatious gas injection well with a gas outlet in the reservoir above the horizontal distal portion of the production well, the gas outlet located one of: within the WLZ; and proximate the WLZ, the oxygenatious gas injection well being separate from the SAGD system and horizontally spaced apart from the SAGD system;

operating the SAGD system, comprising:

injecting steam through the steam injection well to the horizontal distal portion thereof into the reservoir with the effect that steam heat and steam pressure are applied to the bitumen thereby reducing viscosity of the bitumen and mobilizing the bitumen to flow downward under gravity drainage; and extracting bitumen and water from the bitumen-comprising subterranean reservoir into the horizontal distal portion of the production well; and operating the oxygenatious gas injection well by injecting oxygenatious gas through the gas outlet and igniting the bitumen in a combustion zone located one of: within the WLZ; and proximate the WLZ, with the effect that one of: combustion heat energy; oxygenatious gas pressure; steam heat and steam pressure generated from vaporized water from the WLZ; and combustion gas pressure is applied to the bitumen reducing viscosity of the bitumen and mobilizing the bitumen to flow downward under gravity drainage.

2. The process according to claim 1, comprising:

installing a produced gas (PG) extraction well with an inlet within the bitumen-comprising subterranean reservoir, the PG extraction well being separate from the SAGD system and horizontally spaced apart from the SAGD system; and operating the PG extraction well to extract non-condensable gas.

3. The process according to claim 2, wherein the inlet of the PG extraction well is located one of: within the WLZ: above the WLZ; proximate the WLZ; and remote from the WLZ.

4. The process according to claim 2, comprising:

controlling the formation of the combustion zone by controlling one of: the injection of oxygenatious gas; and the extraction of produced gas.

5. The process according to claim 4, wherein one of: a plurality of oxygenatious gas injection well outlets; and a plurality of PG extraction well inlets, are spaced apart horizontally to control the formation of the combustion zone.

6. The process according to claim 1, wherein the outlet of the oxygenatious gas injection well is located within the WLZ, the process comprising dispersing oxygenatious gas horizontally through the WLZ to control the formation of the combustion zone.

7. The process according to claim 1, wherein the bitumen-comprising subterranean reservoir is at least partially depleted before operating the SAGD system.

8. The process according to claim 7, wherein the bitumen-comprising subterranean reservoir is at least partially depleted by operating the SAGD system before operating the oxygenatious gas injection well.

9. The process according to claim 1, wherein prior to operating the SAGD system, the bitumen within the bitumen-comprising subterranean reservoir has an initial in-situ density of less than 10 API and an initial in-situ viscosity of greater than $10^5$ cp.

10. The process according to claim 1, wherein the step of operating the oxygenatious gas injection well comprises injecting oxygenatious gas into the WLZ to oxidize bitumen within the WLZ and vaporize water within the WLZ.

11. The process according to claim 1, wherein the WLZ contains a mixture of bitumen and water, the mixture being at least 5.5% bitumen by volume.

12. A process to produce bitumen from a bitumen-comprising subterranean reservoir having a barrier of lower permeability than the remainder of the reservoir, the barrier comprising one of: shale; mudstone; and a combination of shale and mudstone, the barrier comprising one of: a continuous horizontal barrier; a discontinuous barrier; and a plurality of discontinuous barriers spaced apart horizontally or vertically, the process comprising:

installing a steam assisted gravity drainage (SAGD) system within the reservoir, the SAGD system comprising:

a production well having a horizontal distal portion and a vertical proximal portion in communication with an extraction pump; and a steam injection well having a horizontal distal portion above the horizontal distal portion of the production well and a vertical proximal portion in communication with a steam source;

installing an oxygenatious gas injection well with a gas outlet in the reservoir above the horizontal distal portion of the production well, the gas outlet located one of: above the barrier, and below the barrier, the oxygenatious gas injection well being separate from the SAGD system and horizontally spaced apart from the SAGD system;

operating the SAGD system, comprising:

injecting steam through the steam injection well to the horizontal distal portion thereof into the reservoir with the effect that steam heat and steam pressure are applied to the bitumen thereby reducing viscosity of the bitumen and mobilizing the bitumen to flow downward under gravity drainage; and extracting bitumen and water from the bitumen-comprising subterranean reservoir into the horizontal distal portion of the production well; and operating the oxygenatious gas injection well by injecting oxygenatious gas through the gas outlet and igniting the bitumen in a combustion zone located one of: above the barrier, and below the barrier, with the effect that one of: combustion heat energy; oxygenatious gas pressure; steam heat and steam pressure generated from vaporized water from the combustion zone; and combustion gas pressure is applied to the bitumen reducing viscosity of the bitumen and mobilizing the bitumen to flow downward under gravity drainage.

13. The process according to claim 12, comprising:

installing a produced gas (PG) extraction well with an inlet within the bitumen-comprising subterranean reservoir located one of: above the barrier; and below the barrier, the PG extraction well being separate from the SAGD system and horizontally spaced apart from the SAGD system; and operating the PG extraction well to extract non-condensable gas.

14. The process according to claim 13 wherein:

the gas outlet of the oxygenatious gas injection well is located in a central portion of the discontinuous barrier and below the discontinuous barrier; and the inlet of the PG extraction well is located above the discontinuous barrier.

15. The process according to claim 13 wherein:

the barrier comprises a continuous barrier;

the oxygenatious gas injection well has gas outlets located above and below the continuous barrier, and the PG extraction well has inlets located above and below the continuous barrier.

16. The process according to claim 15 wherein the step of operating the oxygenatious gas injection well comprises igniting the bitumen in a first combustion zone located below the barrier, before igniting the bitumen in a second combustion zone located above the barrier.

17. A process to produce bitumen from a bitumen-comprising subterranean reservoir having a top gas layer with a top gas pressure, the process comprising:

installing a steam assisted gravity drainage (SAGD) system within the reservoir, the SAGD system comprising:

a production well having a horizontal distal portion and a vertical proximal portion in communication with an extraction pump; and a steam injection well having a horizontal distal portion above the horizontal distal portion of the production well and a vertical proximal portion in communication with a steam source;

installing an oxygenatious gas injection well with a gas outlet in the reservoir above the horizontal distal portion of the production well, the gas outlet located below the top gas layer, the oxygenatious gas injection well being separate from the SAGD system and horizontally spaced apart from the SAGD system;

operating the SAGD system, comprising:

injecting steam through the steam injection well to the horizontal distal portion thereof into the reservoir with the effect that steam heat and steam pressure are applied to the bitumen thereby reducing viscosity of the bitumen and mobilizing the bitumen to flow downward under gravity drainage; and extracting bitumen and water from the bitumen-comprising subterranean reservoir into the horizontal distal portion of the production well;

operating the oxygenatious gas injection well by injecting oxygenatious gas through the gas outlet and igniting the bitumen in a combustion zone located below the top gas layer, with the effect that one of: combustion heat energy; oxygenatious gas pressure; steam heat and steam pressure generated from vaporized water from the combustion zone; and combustion gas pressure is applied to the bitumen reducing viscosity of the bitumen and mobilizing the bitumen to flow downward under gravity drainage; and regulating the injection of oxygenatious gas to maintain a gas pressure within the reservoir to be in the range of 90% to 110% of the top gas pressure.

18. The process according to claim 17, comprising:

installing a produced gas (PG) extraction well with an inlet within the top gas layer, the PG extraction well being separate from the SAGD system and horizontally spaced apart from the SAGD system;

operating the PG extraction well to extract non-condensable gas; and regulating the extraction of produced gas to maintain a gas pressure within the reservoir to be in the range of 90% to 110% of the top gas pressure.

19. A process to produce bitumen from a bitumen-comprising subterranean reservoir having a bottom water layer with a bottom water pressure, the process comprising:

installing a steam assisted gravity drainage (SAGD) system within the reservoir, the SAGD system comprising:

a production well having a horizontal distal portion and a vertical proximal portion in communication with an extraction pump; and a steam injection well having a horizontal distal portion above the horizontal distal portion of the production well and a vertical proximal portion in communication with a steam source:

installing an oxygenatious gas injection well with a gas outlet in the reservoir above the horizontal distal portion of the production well, the oxygenatious gas injection well being separate from the SAGD system and horizontally spaced apart from the SAGD system;

operating the SAGD system, comprising:

injecting steam through the steam injection well to the horizontal distal portion thereof into the reservoir with the effect that steam heat and steam pressure are applied to the bitumen thereby reducing viscosity of the bitumen and mobilizing the bitumen to flow downward under gravity drainage; and extracting bitumen and water from the bitumen-comprising subterranean reservoir into the horizontal distal portion of the production well;

operating the oxygenatious gas injection well by injecting oxygenatious gas through the gas outlet and igniting the bitumen in a combustion zone located above the bottom water layer, with the effect that one of: combustion heat energy; oxygenatious gas pressure; steam heat and steam pressure generated from vaporized water from the combustion zone; and combustion gas pressure is applied to the bitumen reducing viscosity of the bitumen and mobilizing the bitumen to flow downward under gravity drainage; and regulating the injection of oxygenatious gas to maintain a gas pressure within the reservoir to be in the range of 90% to 110% of the bottom water pressure.

20. The process according to claim 19, comprising:

installing a produced gas (PG) extraction well with an inlet within the reservoir, the PG extraction well being separate from the SAGD system and horizontally spaced apart from the SAGD system;

operating the PG extraction well to extract non-condensable gas; and regulating the extraction of produced gas to maintain a gas pressure within the reservoir to be in the range of 90% to 110% of the bottom water pressure.

21. A process to produce bitumen from a bitumen-comprising subterranean reservoir having a top water layer with a top water pressure, the process comprising:

installing a steam assisted gravity drainage (SAGD) system within the reservoir, the SAGD system comprising:

a production well having a horizontal distal portion and a vertical proximal portion in communication with an extraction pump; and a steam injection well having a horizontal distal portion above the horizontal distal portion of the production well and a vertical proximal portion in communication with a steam source;

installing an oxygenatious gas injection well with a gas outlet in the reservoir above the horizontal distal portion of the production well, the oxygenatious gas injection well being separate from the SAGD system and horizontally spaced apart from the SAGD system;

operating the SAGD system, comprising:

injecting steam through the steam injection well to the horizontal distal portion thereof into the reservoir with the effect that steam heat and steam pressure are applied to the bitumen thereby reducing viscosity of the bitumen and mobilizing the bitumen to flow downward under gravity drainage; and extracting bitumen and water from the bitumen-comprising subterranean reservoir into the horizontal distal portion of the production well;

operating the oxygenatious gas injection well by injecting oxygenatious gas through the gas outlet and igniting the bitumen in a combustion zone located below the top water layer, with the effect that one of: combustion heat energy; oxygenatious gas pressure; steam heat and steam pressure generated from vaporized water from the combustion zone; and combustion gas pressure is applied to the bitumen reducing viscosity of the bitumen and mobilizing the bitumen to flow downward under gravity drainage; and regulating the injection of oxygenatious gas to maintain a gas pressure within the reservoir to be in the range of 90% to 110% of the top water pressure.

22. The process according to claim 21, comprising:

installing a produced gas (PG) extraction well with an inlet within the reservoir, the PG extraction well being separate from the SAGD system and horizontally spaced apart from the SAGD system;

operating the PG extraction well to extract non-condensable gas; and regulating the extraction of produced gas to maintain a gas pressure within the reservoir to be in the range of 90% to 110% of the top water pressure.

23. A process to produce bitumen from a bitumen-comprising subterranean reservoir having a net pay thickness less than 15 meters, the process comprising:

installing a steam assisted gravity drainage (SAGD) system within the reservoir, the SAGD system comprising:

a production well having a horizontal distal portion and a vertical proximal portion in communication with an extraction pump; and a steam injection well having a horizontal distal portion above the horizontal distal portion of the production well and a vertical proximal portion in communication with a steam source;

installing an oxygenatious gas injection well with a gas outlet in the reservoir above the horizontal distal portion of the production well, the oxygenatious gas injection well being separate from the SAGD system and horizontally spaced apart from the SAGD system;

operating the SAGD system, comprising:

injecting steam through the steam injection well to the horizontal distal portion thereof into the reservoir with the effect that steam heat and steam pressure are applied to the bitumen thereby reducing viscosity of the bitumen and mobilizing the bitumen to flow downward under gravity drainage; and extracting bitumen and water from the bitumen-comprising subterranean reservoir into the horizontal distal portion of the production well; and operating the oxygenatious gas injection well by injecting oxygenatious gas through the gas outlet and igniting the bitumen in a combustion zone located above the production well, with the effect that one of: combustion heat energy; oxygenatious gas pressure; steam heat and steam pressure generated from vaporized water from the combustion zone; and combustion gas pressure is applied to the bitumen reducing viscosity of the bitumen and mobilizing the bitumen to flow downward under gravity drainage.

24. The process according to claim 23 wherein a ratio of injected oxygenacious gas to injected steam is in the range of 0.5 to 1.0 by volume.

25. A process to produce bitumen from a bitumen-comprising subterranean reservoir having a vertical bitumen viscosity gradient wherein a bottom zone has a bitumen viscosity greater than that of a top zone, the process comprising:

installing a top zone steam assisted gravity drainage (SAGD) system within the top zone of the reservoir, the top zone SAGD system comprising:

a top zone production well having a horizontal distal portion and a vertical proximal portion in communication with an extraction pump; and a top zone steam injection well having a horizontal distal portion above the horizontal distal portion of the top zone production well and a vertical proximal portion in communication with a steam source;

installing an oxygenatious gas injection well with a gas outlet in the reservoir above the horizontal distal portion of the top zone production well, the oxygenatious gas injection well being separate from the top zone SAGD system and horizontally spaced apart from the top zone SAGD system;

operating the top zone SAGD system, comprising:

injecting steam through the steam injection well to the horizontal distal portion thereof into the reservoir with the effect that steam heat and steam pressure are applied to the bitumen thereby reducing viscosity of the bitumen and mobilizing the bitumen to flow downward under gravity drainage; and extracting bitumen and water from the bitumen-comprising subterranean reservoir into the horizontal distal portion of the production well;

operating the oxygenatious gas injection well by injecting oxygenatious gas through the gas outlet and igniting the bitumen in a combustion zone located above the top zone production well, with the effect that one of: combustion heat energy; oxygenatious gas pressure; steam heat and steam pressure generated from vaporized water from the combustion zone; and combustion gas pressure is applied to the bitumen reducing viscosity of the bitumen and mobilizing the bitumen to flow downward under gravity drainage.

26. The process according to claim 25 comprising:

depleting the top zone of bitumen;

installing a bottom zone steam assisted gravity drainage (SAGD) system within the bottom zone of the reservoir, the bottom zone SAGD system comprising:

a bottom zone production well having a horizontal distal portion and a vertical proximal portion in communication with an extraction pump; and a bottom zone steam injection well having a horizontal distal portion above the horizontal distal portion of the bottom zone production well and a vertical proximal portion in communication with a steam source.

* * * * *